US009261270B2

(12) United States Patent
Ruud et al.

(10) Patent No.: US 9,261,270 B2
(45) **Date of Patent: *Feb. 16, 2016**

(54) LED LIGHTING FIXTURE

(71) Applicant: Cree, Inc., Durham, NC (US)

(72) Inventors: Alan J. Ruud, Racine, WI (US); Kurt S. Wilcox, Libertyville, IL (US); Steven R. Walczak, Kenosha, WI (US); Wayne Guillien, Franksville, WI (US)

(73) Assignee: Cree, Inc., Durham, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/708,558

(22) Filed: May 11, 2015

(65) Prior Publication Data

US 2015/0241051 A1 Aug. 27, 2015

Related U.S. Application Data

(63) Continuation of application No. 13/834,525, filed on Mar. 15, 2013, now Pat. No. 9,039,223, which is a continuation of application No. 13/294,459, filed on Nov. 11, 2011, now Pat. No. 8,425,071, which is a (Continued)

(51) Int. Cl.
*F21V 29/00* (2015.01)
*F21V 29/83* (2015.01)
(Continued)

(52) U.S. Cl.
CPC . *F21V 29/83* (2015.01); *F21K 9/10* (2013.01); *F21S 2/005* (2013.01); *F21S 8/033* (2013.01); *F21S 8/086* (2013.01); *F21S 9/022* (2013.01); *F21V 19/003* (2013.01); *F21V 19/045* (2013.01); *F21V 21/30* (2013.01); *F21V 23/009* (2013.01); *F21V 23/02* (2013.01); *F21V 27/00* (2013.01); *F21V 29/02* (2013.01);
(Continued)

(58) Field of Classification Search
CPC ..... F21K 9/00; F21V 29/006; F21V 29/507; F21V 29/80
USPC ..... 362/249.02, 373, 294
See application file for complete search history.

(56) References Cited

U.S. PATENT DOCUMENTS 1,225,301 A 5/1917 Wolfe
2,772,382 A 11/1956 Escoffery
(Continued)

FOREIGN PATENT DOCUMENTS

CN ZL200420110545 12/2004
CN 1737418 A 8/2005
(Continued)

OTHER PUBLICATIONS

Excerpt from Aavid Thermalloy (www.aavidthermalloy.com). Part Specificiation. 1 page. Date: Copyright 2006.
(Continued)

*Primary Examiner* — Anabel Ton
(74) *Attorney, Agent, or Firm* — Jansson Munger KcKinley & Kirby Ltd

(57) ABSTRACT

A light fixture comprising a chamber, at least one power-circuitry driver within the chamber, at least one LED module outside the chamber, and at least one air gap between the chamber and the at least one LED module, the air gap permitting air/water-flow therethrough. The chamber is defined by a housing. The at least one LED module is on an LED heat sink outside the chamber. The housing defines the air gap permitting air/water-flow to and from the heat sink.

12 Claims, 15 Drawing Sheets

Related U.S. Application Data continuation of application No. 12/629,986, filed on Dec. 3, 2009, now Pat. No. 8,070,306, which is a continuation of application No. 11/860,887, filed on Sep. 25, 2007, now Pat. No. 7,686,469, which is a continuation-in-part of application No. 11/541,908, filed on Sep. 30, 2006, now abandoned.

(51) Int. Cl.

| | |
|---|---|
| ***F21V 29/02*** | (2006.01) |
| ***F21S 2/00*** | (2006.01) |
| ***F21S 8/00*** | (2006.01) |
| ***F21V 19/00*** | (2006.01) |
| ***F21V 21/30*** | (2006.01) |
| ***F21V 23/02*** | (2006.01) |
| ***F21V 27/00*** | (2006.01) |
| ***F21V 31/03*** | (2006.01) |
| ***F21S 9/02*** | (2006.01) |
| ***F21V 19/04*** | (2006.01) |
| ***F21S 8/08*** | (2006.01) |
| ***F21V 29/70*** | (2015.01) |
| ***F21V 29/71*** | (2015.01) |
| ***F21V 29/75*** | (2015.01) |
| ***F21V 29/76*** | (2015.01) |
| ***F21V 29/507*** | (2015.01) |
| ***F21V 29/74*** | (2015.01) |
| ***F21V 23/00*** | (2015.01) |
| *F21V 21/005* | (2006.01) |
| *F21W 131/10* | (2006.01) |
| *F21W 131/103* | (2006.01) |
| *F21Y 101/02* | (2006.01) |
| *F21K 99/00* | (2010.01) |
| *F21Y 105/00* | (2006.01) |
| *F21W 131/40* | (2006.01) |

(52) U.S. Cl.

CPC ..... *F21V 29/22* (2013.01); *F21V 29/507* (2015.01); *F21V 29/70* (2015.01); *F21V 29/71* (2015.01); *F21V 29/74* (2015.01); *F21V 29/75* (2015.01); *F21V 29/763* (2015.01); *F21V 31/03* (2013.01); *F21K 9/00* (2013.01); *F21V 21/005* (2013.01); *F21W 2131/10* (2013.01); *F21W 2131/103* (2013.01); *F21W 2131/40* (2013.01); *F21Y 2101/02* (2013.01); *F21Y 2105/001* (2013.01); *Y10S 362/80* (2013.01)

(56) References Cited

U.S. PATENT DOCUMENTS

| | | | |
|---|---|---|---|
| 3,184,199 | A | 5/1965 | Clark et al. |
| 3,652,047 | A | 3/1972 | Starr |
| 3,800,177 | A | 3/1974 | Russ |
| 3,819,929 | A | 6/1974 | Newman |
| 3,860,829 | A | 1/1975 | Fabbri |
| 3,889,147 | A | 6/1975 | Groves |
| D246,203 | S | 10/1977 | Harris |
| 4,071,749 | A | 1/1978 | Balogh |
| 4,156,891 | A | 5/1979 | Roche |
| 4,167,033 | A | 9/1979 | Fletcher |
| 4,187,711 | A | 2/1980 | Lavochkin et al. |
| 4,203,488 | A | 5/1980 | Johnson et al. |
| 4,228,489 | A | 10/1980 | Martin |
| 4,235,285 | A | 11/1980 | Johnson et al. |
| 4,254,453 | A | 3/1981 | Mouyard et al. |
| 4,264,946 | A | 4/1981 | Faux et al. |
| D266,080 | S | 9/1982 | Asanuma |
| D266,081 | S | 9/1982 | Asanuma |
| D266,082 | S | 9/1982 | Asanuma |
| 4,426,676 | A | 1/1984 | Taylor |
| 4,460,945 | A | 7/1984 | Chan et al. |
| D275,749 | S | 10/1984 | McCarthy |
| 4,508,163 | A | 4/1985 | McCarthy |
| 4,552,206 | A | 11/1985 | Johnson et al. |
| D285,194 | S | 8/1986 | McCarthy |
| 4,679,118 | A | 7/1987 | Johnson et al. |
| 4,729,076 | A | 3/1988 | Masami et al. |
| D296,778 | S | 7/1988 | McCarthy |
| 4,787,019 | A | 11/1988 | Van Den Broeke et al. |
| 4,793,581 | A | 12/1988 | Bilson et al. |
| 4,875,057 | A | 10/1989 | Hediger et al. |
| 4,899,210 | A | 2/1990 | Lorenzetti et al. |
| 4,931,917 | A | 6/1990 | Scherf et al. |
| 5,004,953 | A | 4/1991 | McDonald |
| 5,119,174 | A | 6/1992 | Chen |
| 5,136,493 | A | 8/1992 | Straus et al. |
| 5,172,755 | A | 12/1992 | Samarov |
| 5,226,723 | A | 7/1993 | Chen |
| D338,449 | S | 8/1993 | Sahyoun |
| 5,274,250 | A | 12/1993 | Miyake et al. |
| 5,285,350 | A | 2/1994 | Villaume |
| 5,303,124 | A | 4/1994 | Wrobel |
| 5,304,735 | A | 4/1994 | Earl et al. |
| 5,381,041 | A | 1/1995 | Harmon |
| 5,381,305 | A | 1/1995 | Harmon et al. |
| 5,384,940 | A | 1/1995 | Soule et al. |
| 5,398,177 | A | 3/1995 | Harwood et al. |
| 5,436,798 | A | 7/1995 | Wieland, Jr. |
| D361,317 | S | 8/1995 | Harmon et al. |
| D361,986 | S | 9/1995 | Harmon |
| 5,494,098 | A | 2/1996 | Morosas |
| 5,562,146 | A | 10/1996 | Harmon et al. |
| 5,576,933 | A | 11/1996 | Campanella et al. |
| D376,349 | S | 12/1996 | Campanella et al. |
| 5,581,442 | A | 12/1996 | Morosas |
| 5,586,004 | A | 12/1996 | Green et al. |
| 5,593,225 | A | 1/1997 | Safyan |
| 5,611,393 | A | 3/1997 | Vasconcelos et al. |
| 5,617,131 | A | 4/1997 | Murano et al. |
| 5,623,551 | A | 4/1997 | East et al. |
| 5,633,564 | A | 5/1997 | Edwards et al. |
| 5,660,461 | A | 8/1997 | Ignatius et al. |
| D384,040 | S | 9/1997 | Frerichs et al. |
| 5,676,455 | A | 10/1997 | Johnson et al. |
| 5,711,890 | A | 1/1998 | Hawkins et al. |
| D390,539 | S | 2/1998 | Campanella |
| D394,043 | S | 5/1998 | Campanella et al. |
| 5,771,155 | A | 6/1998 | Cook |
| 5,782,555 | A | 7/1998 | Hochstein |
| 5,796,154 | A | 8/1998 | Sano et al. |
| 5,857,767 | A | 1/1999 | Hochstein |
| D407,381 | S | 3/1999 | Campanella |
| 5,894,882 | A | 4/1999 | Kikuchi et al. |
| 5,896,288 | A | 4/1999 | Lecheler et al. |
| 5,909,062 | A | 6/1999 | Krietzman |
| 5,936,353 | A | 8/1999 | Triner et al. |
| 5,984,494 | A | 11/1999 | Chapman et al. |
| 5,988,829 | A | 11/1999 | Holder |
| 6,011,299 | A | 1/2000 | Brench |
| 6,045,232 | A | 4/2000 | Buckmaster |
| 6,045,239 | A | 4/2000 | Waldmann et al. |
| 6,045,240 | A | 4/2000 | Hochstein |
| 6,056,254 | A | 5/2000 | Albright et al. |
| 6,155,701 | A | 12/2000 | Leen |
| D442,565 | S | 5/2001 | Chou et al. |
| D442,566 | S | 5/2001 | Chou et al. |
| 6,227,684 | B1 | 5/2001 | Wijbenga et al. |
| 6,229,160 | B1 | 5/2001 | Krames et al. |
| D445,922 | S | 7/2001 | Yasuoka |
| 6,255,786 | B1 | 7/2001 | Yen |
| 6,274,924 | B1 | 8/2001 | Carey et al. |
| D450,306 | S | 11/2001 | Lin et al. |
| 6,323,063 | B2 | 11/2001 | Krames et al. |
| 6,325,524 | B1 | 12/2001 | Weber et al. |
| 6,329,593 | B1 | 12/2001 | Yang |
| 6,357,895 | B1 | 3/2002 | Kierulf et al. |
| 6,375,340 | B1 | 4/2002 | Biebl et al. |
| 6,401,806 | B1 | 6/2002 | Lee et al. |
| 6,414,343 | B1 | 7/2002 | Kondo et al. |

(56) References Cited

U.S. PATENT DOCUMENTS 6,428,189 B1 8/2002 Hochstein
6,449,151 B1 9/2002 Chen
6,457,837 B1 10/2002 Steffensmeier
D465,462 S 11/2002 Hsieh
6,481,874 B2 11/2002 Petroski
6,486,499 B1 11/2002 Krames et al.
6,498,355 B1 12/2002 Harrah et al.
6,501,103 B1 12/2002 Jory et al.
6,502,956 B1 1/2003 Wu
6,517,218 B2 2/2003 Hochstein
6,521,914 B2 2/2003 Krames et al.
6,522,263 B2 2/2003 Jones
6,527,422 B1 3/2003 Hutchison
6,529,375 B2 3/2003 Miyahara et al.
6,547,249 B2 4/2003 Collins, III et al.
6,554,451 B1 4/2003 Keuper
6,558,021 B2 5/2003 Wu et al.
6,565,238 B1 5/2003 Pyrtle
6,570,190 B2 5/2003 Krames et al.
6,578,986 B2 6/2003 Swaris et al.
6,612,717 B2 9/2003 Yen
6,614,103 B1 9/2003 Durocher et al.
D481,017 S 10/2003 Hsia et al.
6,630,736 B1 10/2003 Ignaut
6,635,911 B2 10/2003 Maruyama
6,635,941 B2 10/2003 Suda
6,641,284 B2 11/2003 Stopa et al.
6,648,496 B1 11/2003 Elghoroury et al.
6,657,862 B2 12/2003 Crocker et al.
6,666,567 B1 12/2003 Feldman et al.
6,676,279 B1 1/2004 Hubbell et al.
6,688,380 B2 2/2004 Lavochkin et al.
6,720,566 B2 4/2004 Blandford
6,730,940 B1 5/2004 Steranka et al.
D493,151 S 7/2004 Lee
D494,549 S 8/2004 Lee
6,784,357 B1 8/2004 Wang
6,815,724 B2 11/2004 Dry
6,834,981 B2 12/2004 Nagai et al.
6,837,605 B2 1/2005 Reill
6,841,931 B2 1/2005 Takahashi et al.
6,851,531 B2 2/2005 Sasse
6,857,767 B2 2/2005 Matsui et al.
6,860,620 B2 3/2005 Kuan et al.
6,864,513 B2 3/2005 Lin et al.
6,871,993 B2 3/2005 Hecht
6,876,008 B2 4/2005 Bhat et al.
6,885,035 B2 4/2005 Bhat et al.
D505,220 S 5/2005 Stekelenburg
6,893,941 B2 5/2005 Suda
6,914,261 B2 7/2005 Ho
RE38,767 E 8/2005 Wedell et al.
6,932,495 B2 8/2005 Sloan et al.
6,934,153 B2 8/2005 Lee et al.
6,935,410 B2 8/2005 Lee et al.
6,957,905 B1 10/2005 Pritchard et al.
6,958,914 B2 10/2005 Hoss
6,959,996 B2 11/2005 Ip
6,969,946 B2 11/2005 Steranka et al.
6,972,439 B1 12/2005 Kim et al.
6,999,318 B2 2/2006 Newby
7,008,080 B2 3/2006 Bachl et al.
7,009,213 B2 3/2006 Camras et al.
7,019,334 B2 3/2006 Yatsuda et al.
7,036,961 B2 5/2006 Defouw et al.
7,045,965 B2 5/2006 Li et al.
7,055,987 B2 6/2006 Staufert
7,056,116 B2 6/2006 Scott et al.
7,063,451 B2 6/2006 Shen
7,078,258 B2 7/2006 Sakoh et al.
7,080,932 B2 7/2006 Keuper
7,081,645 B2 7/2006 Chen et al.
D526,972 S 8/2006 Egawa et al.
7,090,370 B2 8/2006 Clark et al.
7,102,185 B2 9/2006 Nichols et al.
7,114,830 B2 10/2006 Robertson et al.
7,141,825 B2 11/2006 Horio et al.
7,153,004 B2 12/2006 Galli
D536,816 S 2/2007 Mier-Langner et al.
D536,817 S 2/2007 Mier-Langner et al.
7,176,070 B2 2/2007 Lee et al.
7,178,941 B2 2/2007 Roberge et al.
7,182,480 B2 2/2007 Kan
D537,972 S 3/2007 Mier-Langner et al.
D537,973 S 3/2007 Mier-Langner et al.
D538,459 S 3/2007 Rose et al.
D538,961 S 3/2007 Mier-Langner et al.
D539,460 S 3/2007 Mier-Langner et al.
D539,956 S 4/2007 Rose et al.
7,199,529 B2 4/2007 Vernon-Dier
7,234,844 B2 6/2007 Bolta et al.
7,237,936 B1 7/2007 Gibson
7,244,042 B1 7/2007 Bieberdorf
D551,379 S 9/2007 Maxik
7,267,459 B2 9/2007 Matheson
7,269,009 B2 9/2007 Ryu et al.
7,273,987 B2 9/2007 Becker et al.
7,278,761 B2 10/2007 Kuan
7,281,818 B2 10/2007 You et al.
7,288,796 B2 10/2007 Dry
7,303,301 B2 12/2007 Koren et al. ..... 362/101
D563,013 S 2/2008 Levine
7,329,030 B1 2/2008 Wang
7,329,033 B2 2/2008 Glovatsky et al.
D563,580 S 3/2008 Prazoff
D563,582 S 3/2008 Levine
D564,117 S 3/2008 Lippert
7,348,604 B2 3/2008 Matheson
D571,032 S 6/2008 Chen
7,434,959 B1 10/2008 Wang
7,434,964 B1 10/2008 Zheng et al.
7,461,952 B2 12/2008 Trenchardl et al.
7,488,090 B1 2/2009 Bucher et al.
7,503,669 B2 3/2009 Rizkin et al.
7,513,639 B2 4/2009 Wang
7,530,711 B2 5/2009 Bang
7,534,009 B2 5/2009 Trojanowski et al.
7,543,953 B2 6/2009 Chapman
7,549,774 B2 6/2009 Tsai
7,566,147 B2 7/2009 Wilcox et al.
7,569,802 B1 8/2009 Mullins
7,572,027 B2 8/2009 Zampini, II et al.
7,575,354 B2 8/2009 Woodward
D599,494 S 9/2009 Levine
7,591,567 B2 9/2009 Wilcox et al.
7,637,624 B2 12/2009 Chin
7,637,630 B2 12/2009 Wilcox et al.
7,637,633 B2 * 12/2009 Wong ..... 362/294
7,654,691 B2 2/2010 Liu et al.
7,665,699 B2 2/2010 Oddsen, Jr. et al.
7,665,862 B2 2/2010 Villard
7,679,096 B1 3/2010 Ruffin
7,686,469 B2 * 3/2010 Ruud et al. ..... 362/101
7,703,939 B2 4/2010 Wilcox et al.
7,744,236 B2 6/2010 Hsu et al. ..... 362/101
7,744,247 B2 6/2010 Zhang et al.
7,758,211 B2 7/2010 Zheng et al.
7,771,087 B2 8/2010 Wilcox et al.
7,794,116 B2 9/2010 Shuai et al.
D626,264 S 10/2010 Liu
7,828,465 B2 11/2010 Roberge et al.
7,938,558 B2 5/2011 Wilcox et al.
7,952,262 B2 5/2011 Wilcox et al.
7,976,199 B2 7/2011 Berns et al.
8,021,026 B2 9/2011 Liu et al.
8,061,869 B2 11/2011 Lo
8,067,778 B2 11/2011 Bae et al.
8,070,306 B2 * 12/2011 Ruud et al. ..... 362/101
8,092,042 B2 1/2012 Wilcox
8,092,049 B2 1/2012 Kinnune et al.
8,104,933 B2 1/2012 Liu et al.
8,313,221 B2 11/2012 Hsu
8,313,222 B2 11/2012 Kinnune et al.
8,353,606 B2 1/2013 Jeong

(56) References Cited

U.S. PATENT DOCUMENTS

| | | | | |
|---|---|---|---|---|
| 8,393,764 | B2 | 3/2013 | Yao | |
| D681,250 | S | 4/2013 | Ruffalo et al. | |
| 8,425,071 | B2 * | 4/2013 | Ruud et al. | 362/101 |
| 8,425,086 | B2 | 4/2013 | Chen et al. | |
| 9,039,223 | B2 * | 5/2015 | Rudd et al. | 362/101 |
| 2002/0070386 | A1 | 6/2002 | Krames et al. | |
| 2002/0171087 | A1 | 11/2002 | Krames et al. | |
| 2003/0048608 | A1 | 3/2003 | Crocker et al. | |
| 2003/0189829 | A1 | 10/2003 | Shimizu et al. | |
| 2004/0036629 | A1 | 2/2004 | Jones et al. | |
| 2004/0052077 | A1 | 3/2004 | Shih | |
| 2004/0156209 | A1 | 8/2004 | Ishida | |
| 2004/0161338 | A1 | 8/2004 | Hsieh | |
| 2004/0174651 | A1 | 9/2004 | Aisenbrey | |
| 2004/0175189 | A1 | 9/2004 | Weber-Rabsilber et al. | |
| 2004/0212291 | A1 | 10/2004 | Keuper | |
| 2004/0213016 | A1 | 10/2004 | Rice | |
| 2004/0222516 | A1 | 11/2004 | Lin et al. | |
| 2004/0251469 | A1 | 12/2004 | Yatsuda et al. | |
| 2004/0257006 | A1 | 12/2004 | Beeman et al. | |
| 2004/0257808 | A1 | 12/2004 | Bjornson et al. | |
| 2004/0264195 | A1 | 12/2004 | Chang et al. | |
| 2005/0023545 | A1 | 2/2005 | Camras et al. | |
| 2005/0052378 | A1 | 3/2005 | Hacker | |
| 2005/0057939 | A1 | 3/2005 | Mizuyoshi | |
| 2005/0068765 | A1 | 3/2005 | Ertze Encinas et al. | |
| 2005/0072558 | A1 | 4/2005 | Whitney et al. | |
| 2005/0128752 | A1 | 6/2005 | Ewington et al. | |
| 2005/0135093 | A1 | 6/2005 | Alexanderson et al. | |
| 2005/0174762 | A1 | 8/2005 | Fogerlie | |
| 2005/0190562 | A1 | 9/2005 | Keuper et al. | |
| 2005/0213328 | A1 | 9/2005 | Matheson | |
| 2005/0224826 | A1 | 10/2005 | Keuper et al. | |
| 2005/0258446 | A1 | 11/2005 | Raos et al. | |
| 2005/0274959 | A1 | 12/2005 | Kim et al. | |
| 2005/0281033 | A1 | 12/2005 | Coushaine et al. | |
| 2006/0018099 | A1 | 1/2006 | Chen | |
| 2006/0056169 | A1 | 3/2006 | Lodhie et al. | |
| 2006/0061967 | A1 | 3/2006 | Kim et al. | |
| 2006/0097385 | A1 | 5/2006 | Negley | |
| 2006/0105482 | A1 | 5/2006 | Alferink et al. | |
| 2006/0131757 | A1 | 6/2006 | Yu et al. | |
| 2006/0138645 | A1 | 6/2006 | Ng et al. | |
| 2006/0138951 | A1 | 6/2006 | Tain et al. | |
| 2006/0141851 | A1 | 6/2006 | Matsui et al. | |
| 2006/0146531 | A1 | 7/2006 | Reo et al. | |
| 2006/0158080 | A1 | 7/2006 | Nakano et al. | |
| 2006/0169878 | A1 | 8/2006 | Kasano et al. | |
| 2006/0175626 | A1 | 8/2006 | Wall, Jr. | |
| 2006/0176686 | A1 | 8/2006 | McVicker | |
| 2006/0181878 | A1 | 8/2006 | Burkholder | |
| 2006/0187671 | A1 | 8/2006 | Coushaine et al. | |
| 2006/0193139 | A1 | 8/2006 | Sun et al. | |
| 2006/0250803 | A1 | 11/2006 | Chen | |
| 2007/0019415 | A1 | 1/2007 | Leblanc et al. | |
| 2007/0070625 | A1 | 3/2007 | Bang | |
| 2007/0086196 | A1 | 4/2007 | Wong | |
| 2007/0097684 | A1 | 5/2007 | Obara et al. | |
| 2007/0098334 | A1 | 5/2007 | Chen | |
| 2007/0115666 | A1 | 5/2007 | Thomas et al. | |
| 2007/0159827 | A1 | 7/2007 | Huang | |
| 2007/0258214 | A1 | 11/2007 | Shen | |
| 2008/0002399 | A1 | 1/2008 | Villard et al. | |
| 2008/0019129 | A1 | 1/2008 | Wang | |
| 2008/0037239 | A1 | 2/2008 | Thomas et al. | |
| 2008/0043473 | A1 | 2/2008 | Matsui | |
| 2008/0055908 | A1 | 3/2008 | Wu et al. | |
| 2008/0068799 | A1 | 3/2008 | Chan | |
| 2008/0080162 | A1 | 4/2008 | Wilcox et al. | |
| 2008/0080188 | A1 | 4/2008 | Wang | |
| 2008/0080189 | A1 | 4/2008 | Wang | |
| 2008/0080196 | A1 | 4/2008 | Ruud et al. | |
| 2008/0089071 | A1 | 4/2008 | Wang | |
| 2009/0034261 | A1 | 2/2009 | Grove | |
| 2009/0180281 | A1 | 7/2009 | Ahland, III et al. | |
| 2009/0244895 | A1 | 10/2009 | Chen | |
| 2009/0251898 | A1 | 10/2009 | Kinnune et al. | |
| 2009/0268477 | A1 | 10/2009 | Zheng et al. | |
| 2009/0296403 | A1 | 12/2009 | Zhang et al. | |
| 2010/0026158 | A1 | 2/2010 | Wu | |
| 2010/0039013 | A1 | 2/2010 | Tsai | |
| 2010/0046223 | A1 | 2/2010 | Li et al. | |
| 2010/0149809 | A1 | 6/2010 | Ruud et al. | |
| 2010/0195323 | A1 | 8/2010 | Schaefer et al. | |
| 2010/0238671 | A1 | 9/2010 | Catone et al. | |
| 2010/0314985 | A1 | 12/2010 | Premysler | |
| 2011/0013397 | A1 | 1/2011 | Catone et al. | |
| 2011/0089830 | A1 | 4/2011 | Pickard et al. | |
| 2011/0095690 | A1 | 4/2011 | Sagal | |
| 2011/0188233 | A1 | 8/2011 | Josefowicz et al. | |
| 2011/0222284 | A1 | 9/2011 | Kong et al. | |
| 2011/0299280 | A1 | 12/2011 | Maeers | |
| 2012/0025711 | A1 | 2/2012 | Best et al. | |
| 2012/0057351 | A1 | 3/2012 | Wilcox et al. | |
| 2012/0281404 | A1 | 11/2012 | Wilcox et al. | |
| 2012/0307496 | A1 | 12/2012 | Phillips, III et al. | |
| 2014/0049961 | A1 | 2/2014 | Wilcox et al. | |

FOREIGN PATENT DOCUMENTS

| | | | |
|---|---|---|---|
| CN | 101093073 | A | 12/2007 |
| CN | 101101102 | A | 1/2008 |
| CN | 101101103 | A | 1/2008 |
| CN | 101101104 | A | 1/2008 |
| CN | 101101106 | A | 1/2008 |
| CN | 101101107 | A | 1/2008 |
| CN | 101105268 | A | 1/2008 |
| CN | 101105278 | A | 1/2008 |
| DE | 9417326 | U1 | 2/1995 |
| DE | 10110835 | A1 | 3/2001 |
| DE | 202006015981 | U1 | 10/2006 |
| DE | 2020006010949 | U1 | 10/2006 |
| EP | 1431653 | A2 | 6/2004 |
| EP | 1760393 | A1 | 3/2007 |
| EP | 1906081 | A1 | 4/2008 |
| FR | 2818786 | A1 | 6/2002 |
| GB | 2201042 | A | 8/1988 |
| JP | 59229844 | A | 12/1984 |
| JP | 10268800 | A | 10/1998 |
| JP | 2000183406 | A | 6/2000 |
| JP | 2005109228 | | 4/2005 |
| JP | 2007134190 | | 5/2007 |
| NL | 1026514 | | 6/2004 |
| WO | WO9833007 | A1 | 7/1998 |
| WO | WO9957945 | A1 | 11/1999 |
| WO | WO0125683 | A1 | 12/2001 |
| WO | WO0216826 | A1 | 2/2002 |
| WO | WO03089841 | A1 | 10/2003 |
| WO | WO2004079256 | A1 | 9/2004 |
| WO | WO2006049086 | A1 | 5/2006 |
| WO | WO2006060905 | A1 | 6/2006 |
| WO | WO2007000037 | A1 | 1/2007 |

OTHER PUBLICATIONS

Kramer Lighting, Sturtevant, WI. Excerpts from Kramer Lighting brochure. Quartz Cylinder Downlight specification. Copyright 2010.

Kramer Lighting, Sturtevant, WI. Excerpts from Kramer Lighting brochure. Metal Halide Cylinder Downlightt specification. Copyright 2010.

Affineon Lighting, Coral Springs, FL. Excerpts from Affineon Lighting. DL Downlight specification. Copyright 2009.

Affineon Lighting, Coral Springs, FL. Excerpts from Affineon Lighting. DLM Mini Downlight specification. Copyright 2008.

Philips Lumec, Roadstar Series brochure. Date: 2009. 26 pages. Philips Group, Lumec Head Office, 640 Cure-Boivin Boulevard, Boisbriand, Quebec, Canada J7G 2A7.

Philips Lumec, Roadstar Luminaire brochure. 43 pages.

Philips Roadway Lighting. Product Brochure. Date: Copyright 2010. 12 pages.

Light News. Date: Nov. 2010. 8 pages. Electron AG, Bereich Lichttechnik, Riedhofstrasse 11, Ch-8804 Au ZH.

(56) References Cited

OTHER PUBLICATIONS

Tarricone, Paul. "Coming Soon to Broadway." www.jesna.org. Date: Feb. 2005.
Excerpt from www.ledsmagazine.com. "LED design wins New York city streetlight competition." Date: Dec. 2004.
"Professional Lighting Design." No. 40. Date: Nov./Dec. 2005.
The Lighting Journal. "LED Street Lighting." Date: Jul./Aug. 2006.
Excerpt from enLux Lighting. www.enluxled.com. "enLux 6K Series LED Outdoor Area Light." Date: undated.
Excerpt from enLux Lighting. www.enluxled.com. "enLux 6K Series LED Theatrical Area Light." Date: undated.
Excerpt from enLux Lighting. www.enluxled.com. "enLux 1K LED Light Bar Module." Date: undated.
Alpha One GmbH. "Falcon flood-LED." Date: undated.
Alpha One GmbH. "Savi Architectural LED Lighting" technical specification. Date: undated.
Excerpt from Supervision International website. www.svision.com. "SaVi SHO." Date: Copyright 2006.
Excerpt from Supervision International website. www.svision.com. "SaVi SHO" technical specification. Date: undated.
Leotek brochure. "LED Outdoor Luminaire & Light Fixtures." Date: undated.
In Reexamination of U.S. Pat. No. 8,070,306, PTO Action. Date: May 7, 2012.
In Reexamination of U.S. Pat. No. 8,070,306, response and supporting documents to May 7, 2012 PTO Action. Date: Jul. 9, 2012.
Images from Cooper Lighting's Motion for Leave. Date: 2004.
Images from Cooper Lighting's Motion for Leave. Date: 2005.
Images from Cooper Lighting's Motion for Leave. Date: 2006.
Future Lighting Solutions brochure. "The 6 Steps to LED Lighting Success." 6 pages. Date: undated.
Excerpt from Aavid Thermalloy (www.aavidthermalloy.com). "LED Light Sources." 1 page. Date: Copyright 2006.
Aavid Thermal Technologies, Inc. article. "How to Select a Heat Sink." 5 pages. Date: undated.
Excerpt from Mouser Electronics (www.mouser.com). Product List. 1 page. Date: Aug. 16, 2006.
Excerpt from Lumileds Future Electronics (www.lumiledsfuture.com). "Thermal Solutions." 1 page. Date: Jul. 14, 2006.
Excerpt from National Northeast Corporation brochure. "Miscellaneous Shape Heat Sinks." 2 pages. Date: undated.
Excerpt from Aavid Thermalloy (www.aavidthermalloy.com). Part Specification. 3 pages. Date: Copyright 2006.
Excerpt from Therma-Flo brochure. 8 pages. Date: Copyright 2002.
Excerpt from Aavid Thermalloy (www.aavidthermalloy.com). "Product Offerings." 2 pages. Date: Copyright 2006.
Excerpt from ThermaFlo (www.thermaflow.com). "Bonded Fin Heat Sinks." 1 page. Date: Aug. 24, 2006.
Excerpt from ThermaFlo (www.thermaflow.com). "Folded Fin Heat Sinks." 2 pages. Date: Aug. 24, 2006.
Excerpt from TheimaFlo (www.thermaflow.com). "High Power Heat Sinks." 2 pages. Date: Aug. 24, 2006.
National Northwest Corporation brochure. "Flat Back Shape Heat Sinks III." 12 pages. Date: undated.
Excerpt from Wakefield Thermal Solutions (www.wakefield.com). "Thermal Extrusions." 1 page. Date: Aug. 16, 2006.
Wakefield Thermal Solutions brochure. "Quality Aluminum Extrusion and Fabrication." 4 pages. Date: undated.
Stanley Electric co., Ltd. "Stanley LED for Street Light Brochure." 8 pages. date: Aug. 2006.

* cited by examiner

LED LIGHTING FIXTURE

RELATED APPLICATION

This application is a continuation of patent application Ser. No. 13/834,525, filed Mar. 15, 2013, which is a continuation of patent application Ser. No. 13/294,459, filed Nov. 11, 2011, now Pat. No. 8,425,071, issued Apr. 23, 2013, which is a continuation of patent application Ser. No. 12/629,986, filed Dec. 3, 2009, now Pat. No. 8,070,306, issued Dec. 6, 2011, which is a continuation of patent application Ser. No. 11/860,887, filed Sep. 25, 2007, now Pat. No. 7,686,469, issued Mar. 30, 2010, which is a continuation-in-part of now abandoned patent application Ser. No. 11/541,908, filed Sep. 30, 2006. The entire contents of each of the parent applications are incorporated herein by reference.

FIELD OF THE INVENTION

This invention relates to lighting fixtures and, more particularly, to lighting fixtures using light-emitting diodes (LEDs).

BACKGROUND OF THE INVENTION

In recent years, the use of LEDs for various common lighting purposes has increased, and this trend has accelerated as advances have been made in LEDs and in LED arrays, often referred to as "LED modules." Indeed, lighting applications which previously had been served by fixtures using what are known as high-intensity discharge (HID) lamps are now beginning to be served by fixtures using LEDs. Such lighting applications include, among a good many others, roadway lighting, factory lighting, parking lot lighting, and commercial building lighting.

Lighting fixtures using LEDs as light source for various applications present particularly challenging problems in fixture development, particularly when fixture mounting locations vary. Among other things, placement of the electronic LED power units (LED drivers) for lighting fixtures using LED arrays can be particularly problematic. In some cases, keeping such electronic LED drivers in a air/water-tight location may not be difficult, but if mounting locations and structures vary, then location and protection of such components becomes difficult and adds development costs and potential problems. Lighting-fixture adaptability is an important goal for LED lighting fixtures that are often presented.

Heat dissipation is another problem for LED lighting fixtures. And, the goals of dealing with heat dissipation and protection of electronic LED drivers can often be conflicting, contrary goals.

In short, there is a significant need in the lighting industry for improved lighting fixtures using LED units—fixtures that are adaptable for a wide variety of mountings and situations, and that satisfy the problems associated with heat dissipation and appropriate protection of electronic LED driver components. Finally, there is a need for an improved LED-based lighting fixture which is easy and inexpensive to manufacture.

SUMMARY OF THE INVENTION

The present invention is an improvement in LED lighting fixtures. The inventive LED lighting fixture includes a housing forming a substantially air/water-tight chamber, at least one electronic LED driver enclosed within the chamber, and an LED assembly secured with respect to the housing adjacent thereto in non-air/water-tight condition, the LED assembly having at least one LED-array module mounted on an LED heat sink.

The housing preferably includes substantially air/water-tight wire-access(es) for passage of wires between the LED assembly and the air/water-tight chamber.

The housing includes a first border structure forming a first border-portion of the chamber, the first border structure receiving wires from the at least one LED-array module and the LED heat sink being interlocked with the first border structure. The housing further includes a frame structure forming a frame-portion of the chamber secured to the first border structure, the frame structure extending along the LED assembly. It is preferred that the border structure be a metal extrusion.

In some preferred embodiments, the first border structure has at least one bolt-receiving border-hole through the first border structure, such border-hole being isolated from the first border-portion of the chamber. The frame structure also has at least one bolt-receiving frame-hole through the frame structure, the frame-hole being isolated from the frame-portion of the chamber. Each such one or more frame-holes are aligned with a respective border-hole(s). A bolt passes through each aligned pair of bolt-receiving holes such that the border structures and the frame structure are bolted together while maintaining the air/water-tight condition of the chamber.

In some highly preferred embodiments, the housing includes a second border structure forming a second border-portion of the chamber, the LED heat sink being interlocked with the second border structure. In such embodiments, the frame structure is secured to the first and second border structures.

The frame structure preferably includes an opening edge about the frame-portion of the chamber. A removable cover-plate is preferably in substantial water/air-tight sealing engagement with respect to the opening edge. Such opening edge may also have a groove configured for mating air/water-tight engagement with the border structure(s). It is preferred that one or more electronic LED drivers be enclosed in the frame-portion of the chamber.

In certain preferred embodiments the frame structure preferably includes a vent permitting air flow to and from the LED assembly. Such venting facilitates cooling of the LED assembly.

In certain highly preferred embodiments of this invention, including those used for street lighting and the like, the housing is a perimetrical structure such that the substantially air/water-tight chamber substantially surrounds the LED assembly. The perimetrical structure is preferably substantially rectangular and includes the first and second border structures and a pair of opposed frame structures each secured to the first and second border structures.

In some versions of the inventive LED lighting fixture, the housing is a perimetrical structure configured for wall mounting and includes the first and second border structures on opposed perimetrical sides and the frame structure secured on a perimetrical side between the border structures.

In such embodiments, each of the first and second border structures preferably has at least one bolt-receiving border-hole therethrough isolated from the first and second border-portion of the chamber, respectively. Each of the frame structures has at least one bolt-receiving frame-hole therethrough isolated from the frame-portion of the chamber, each such frame-holes aligned with respective border-holes of each of the border structures. A bolt is passing through each aligned set of bolt-receiving holes such that the border structures and the frame structures are bolted together while maintaining the air/water-tight condition of the chamber.

In certain highly preferred embodiments of the inventive LED lighting fixture, the LED assembly includes a plurality of LED-array modules each separately mounted on its corresponding LED heat sink, the LED heat sinks being interconnected to hold the LED-array modules in fixed relative positions. Each heat sink preferably includes a base with a back base-surface, an opposite base-surface, two base-ends and first and second base-sides. A female side-fin and a male side-fin each extends along one of the opposite base-sides and each protrudes from the opposite base-surface to terminate at a distal fin-edge. The female side-fin includes a flange hook positioned to engage the distal fin-edge of the male side-fin of an adjacent heat sink At least one inner-fin projects from the opposite surface between the side-fins. One of the LED modules is against the back surface.

In some preferred embodiments, each heat sink includes a plurality of inner-fins protruding from the opposite base-surface. Each heat sink may also include first and second lateral supports protruding from the back base-surface, the lateral supports each having an inner portion and an outer portion. The inner portions of the first and second lateral supports have first and second opposed support-ledges, respectively, forming a heat-sink-passageway slidably supporting one of the LED-array modules against the back base-surface. The first and second supports of each heat sink are preferably in substantially planar alignment with the first and second side-fins, respectively. The flange hook is preferably at the distal fin-edge of the first side-fin.

It is highly preferred that each heat sink be a metal extrusion with the back base-surface being substantially flat to facilitate heat transfer from the LED-array module, which itself has a flat surface against the back-base surface.

Each heat sink also preferably includes a lateral recess at the first base-side and a lateral protrusion at the second base-side, the recesses and protrusions being positioned and configured for mating engagement of the protrusion of one heat sink with the recess of the adjacent heat sink.

In certain of the above preferred embodiments, the female and male side-fins are each a continuous wall extending along the first and second base-sides, respectively. It is further preferred that the inner-fins are also each a continuous wall extending along the base. The inner-fins can be substantially parallel to the side-fins.

In highly preferred embodiments, the LED lighting fixture further includes an interlock of the housing to the LED assembly. The interlock has a slotted cavity extending along the housing and a cavity-engaging coupler which extends from the heat sink of the LED assembly and is received within the slotted cavity.

In some of such preferred embodiments, in each heat sink, at least one of the inner-fins is a middle-fin including a fin-end forming a mounting hole receiving a coupler. In some versions of such embodiments, the coupler has a coupler-head; and the interlock is a slotted cavity engaging the coupler-head within the slotted cavity. The slotted cavity preferably extends along the border structure and the coupler-head extends from the heat sink of the LED assembly.

In preferred embodiments of this invention, the LED lighting fixture includes a restraining bracket secured to the housing. The bracket has a plurality of projections extending between adjacent pairs of fins of the heat sink, thus to secure the LED assembly. The restraining bracket preferably has a comb-like structure including an elongated body with a spine-portion from which identical side-by-side projections extend in a common plane. Such restraining bracket is configured and dimensioned for the elongated body to be fixedly secured to the housing and the projections to snugly fit in spaces between adjacent heat-sink fins, thus holding heat sink from moving.

The LED lighting fixture further includes a mounting assembly secured to the housing. The mounting assembly preferably has a pole-attachment portion and a substantially air/water-tight section enclosing electrical connections with at least one wire-aperture communicating with the air/water-tight chamber. The housing is in air/water-tight engagement with the air/water-tight section of the pole-mounting assembly.

In the aforementioned substantially rectangular versions of this invention, in which the perimetrical structure includes a pair of opposed frame structures and a first and second opposed border structures, the second border structure may have two sub-portions with a gap therebetween. The sub-portions each include all of the border-structure elements.

In the mounting assembly of such embodiments, the pole-attachment portion preferably receives and secures a pole. Each wire-aperture communicates with the border-portion chamber of a respective one of the second border-structure sub-portions. The gap between the second border-structure sub-portions accommodates the pole-mounting assembly secured to the LED assembly between the border sub-portions. The second border-structure sub-portion(s) are in air/water-tight engagement with the air/water-tight section of the pole-mounting assembly. The pole-attachment portion preferably includes grooves on its opposite sides, the grooves being configured for mating engagement with end edges of the border-structure sub-portions.

Preferably, the pole-mounting assembly has a mounting plate abutting the LED assembly, and at least one fastener/coupler extends from the mounting plate for engagement with the mounting hole of the middle-fin(s).

In some LED lighting fixtures of this invention, the frame-portion of the chamber has a chamber-divider across the chamber, such chamber-divider having a divider-edge. The chamber-divider divides the frame-portion of the chamber into an end part and a main part that encloses the electronic LED driver(s). The chamber-divider preferably includes a substantially air/water-tight wire-passage therethrough. The wire-passage is preferably a notch having spaced notch-wall ends that terminate at the divider-edge. A notch-bridge spans the notch to maintain the air/water-tight condition of the chamber. The notch-bridge preferably includes a bridge-portion and a pair of gripping-portions configured for spring-grip attachment to the notch-wall ends. Preferably, the removable cover-plate seals the main part of the frame-portion of the chamber in substantially air/water-tight condition.

In certain embodiments of this invention, including those used for parking-structure lighting and the like, the frame structure is a sole frame structure, and the housing is a substantially H-shaped structure with the sole frame structure secured between mid-length positions of the pair of opposed border structures.

Some of the inventive LED lighting fixtures include a protective cover extending over the LED assembly and secured with respect to the housing. Such protective cover preferably has perforations permitting air/water-flow therethrough for access to and from the LED assembly.

It is most highly preferred that the LED lighting fixture has a venting gap between the housing and the LED assembly to permit air/water-flow from the heat sink The venting gap may be formed by the interlock of the housing to the LED assembly.

The improved LED lighting fixture of this invention overcomes the problems discussed above. Among other things, the invention provides substantially air/water-tight enclosure of electronic LED drivers inside the fixture, while still accommodating heat-dissipation requirements. And, the fixture of this invention is both adaptable for varying applications and mountings, and relatively inexpensive to manufacture.

The term "perimetrical structure" as used herein means an outer portion of the fixture which completely or partially surrounds remaining portions of the fixture. In certain preferred embodiments, such as those most useful for road-way lighting and the like, the perimetrical structure preferably completely surrounds remaining portions of the fixture. In certain other cases, such as certain wall-mounted lighting fixtures, the perimetrical structure partially surrounds the remaining portions of the fixture.

The term "ambient fluid" as used herein means air and/or water surrounding the lighting fixture.

DETAILED DESCRIPTION OF PREFERRED EMBODIMENTS

Figure 1:
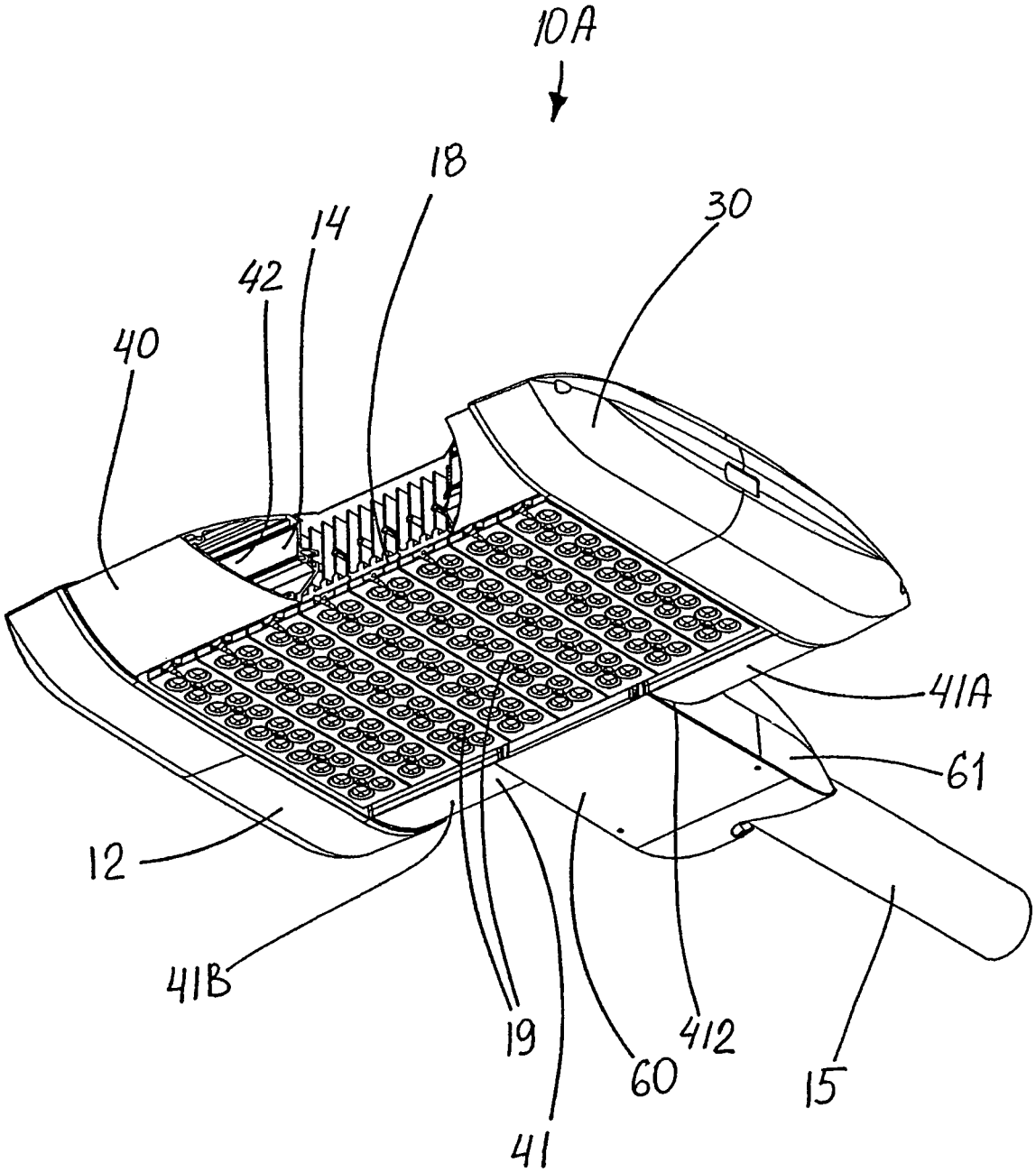
FIG. 1 is a perspective view of a preferred LED lighting fixture in accordance with this invention, including a cut-away portion showing an LED assembly.

FIGS. 1-15 illustrate preferred LED lighting fixtures 10A-10D in accordance with this invention. Common or similar parts are given the same numbers in the drawings of both embodiments, and the lighting fixtures are often referred to by the numeral 10, without the A or D lettering used in the drawings, and in the singular for convenience.

Lighting fixture 10 includes a housing 12 that forms a substantially air/water-tight chamber 14, at least one electronic LED driver 16 enclosed within chamber 14 and an LED assembly 18 secured with respect to housing 12 adjacent thereto in non-air/water-tight condition. LED assembly 18 has a plurality of LED-array modules 19 each secured to an LED heat sink 20.

Figure 7:
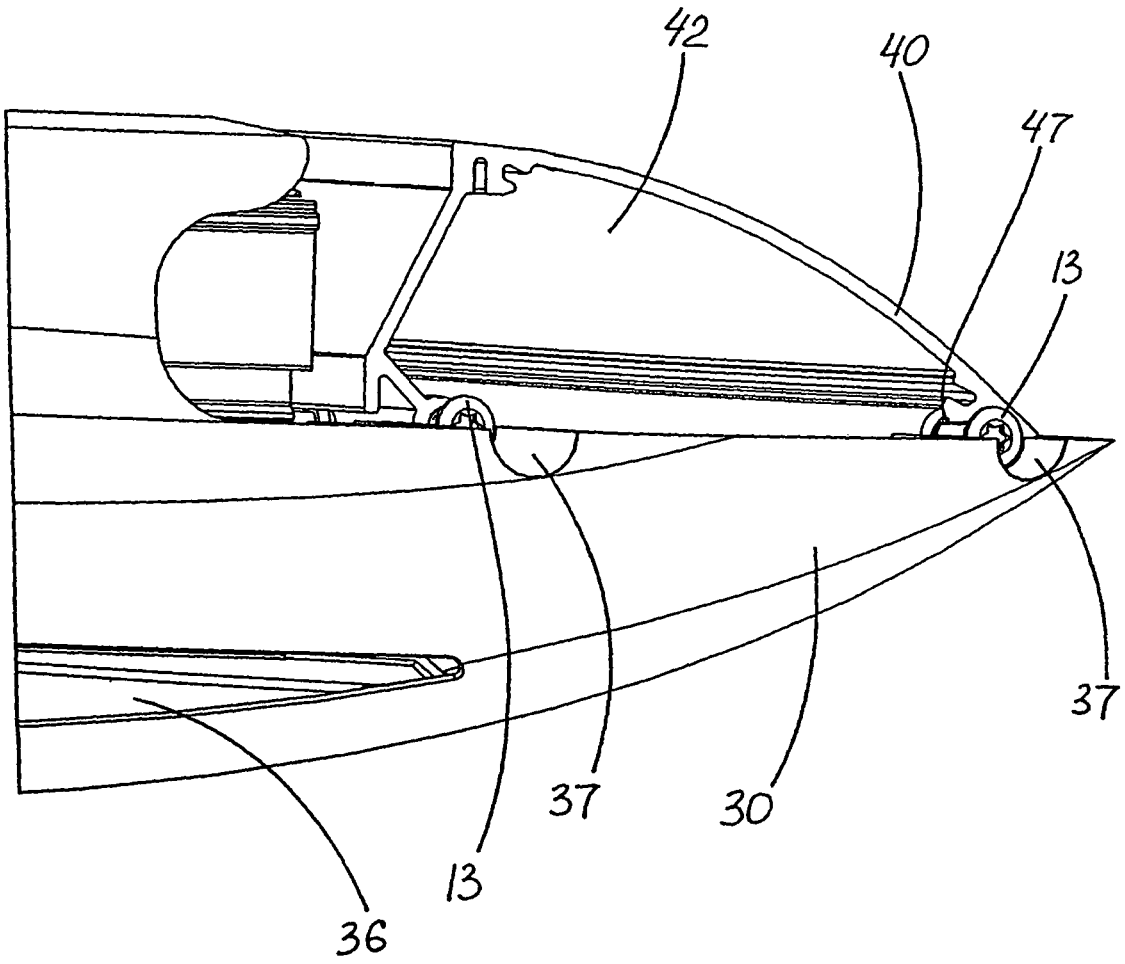
FIG. 7 is another fragmentary perspective view showing the frame structure partially cut-away view to illustrate its being bolted together with the border structure.
Figure 8:
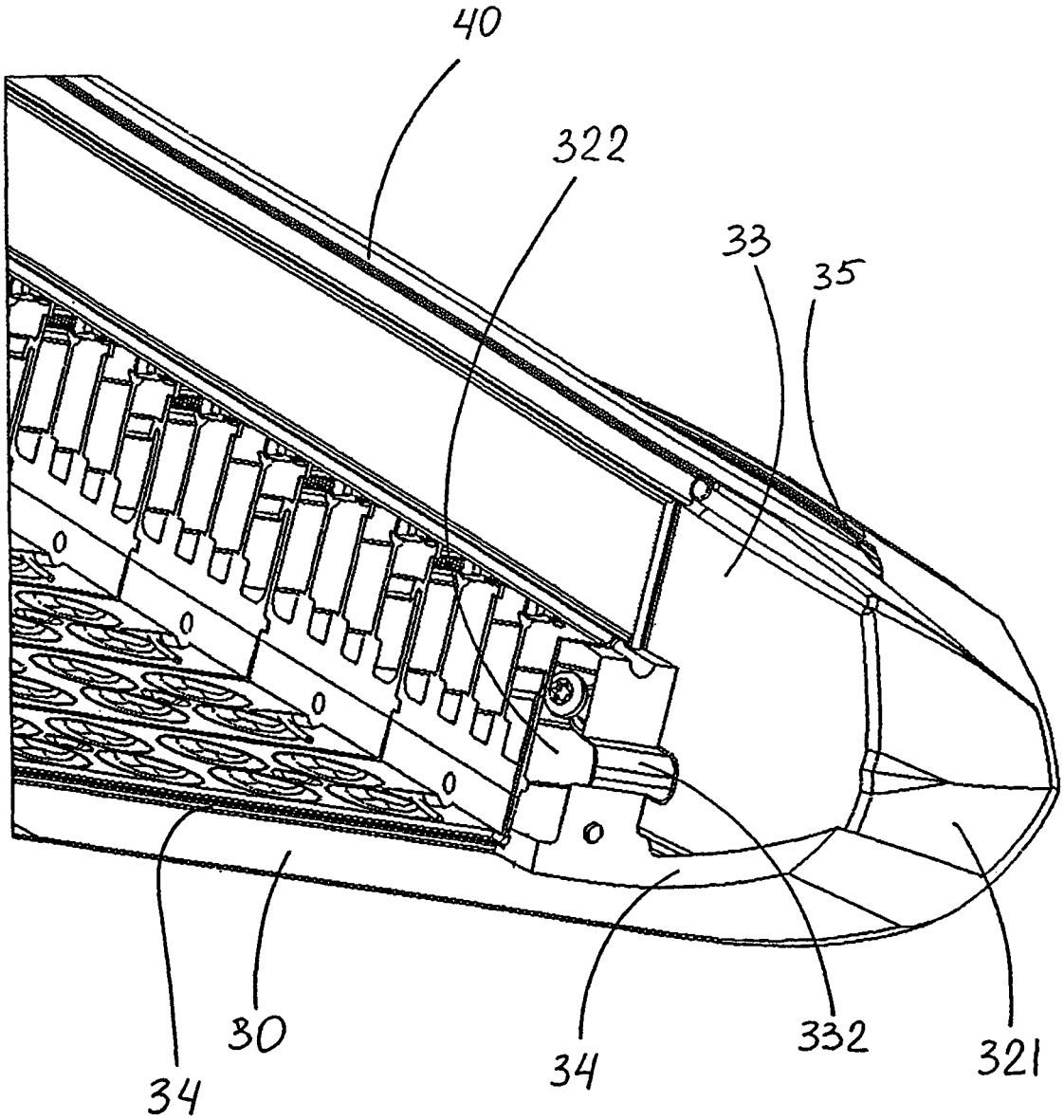
FIG. 8 is another fragmentary perspective view showing the border structure partially cut-away view to illustrate its engagement with the frame structure.

As seen in FIGS. 1-4, 7 and 8, housing 12 includes a frame structure 30 forming a frame-portion 32 of chamber 14 with an opening edge 34 thereabout and a border structure 40 (sometimes referred to as a nose structure 40) secured to frame structure 30 and forming a border-portion 42 (sometimes referred to as nose-portion 42) of chamber 14. As best seen in FIG. 8, opening edge 34 of frame-portion 30 of chamber 14 includes a groove 35 configured for mating air/water-tight engagement with border structure 40. Border structure 40 is an extrusion, preferably of aluminum. FIG. 5 shows electronic LED drivers 16 enclosed in frame-portion 32 of chamber 14.

Figure 6:
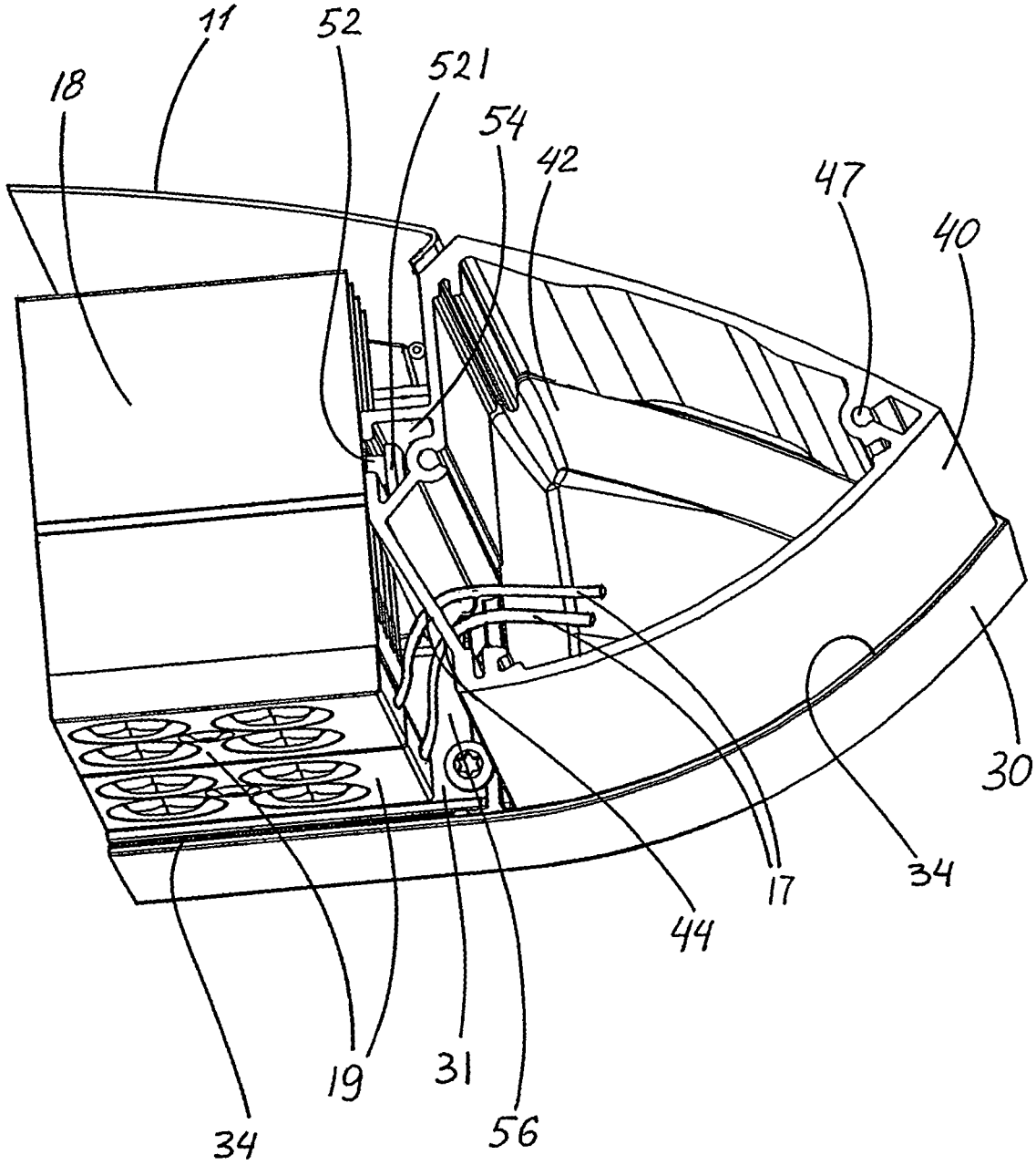
FIG. 6 is a fragmentary view of the right portion of FIG. 4.

As best seen in FIG. 6, border structure 40 includes substantially air/water-tight wire-accesses 44 for passage of wires 17 between LED assembly 18 and water/air-tight chamber 14.

FIGS. 2, 3, 5 and 7 show that frame structure 30 includes a vent 36 permitting air flow to and from LED assembly 18. Vent 36 facilitates cooling of LED assembly 18.

As best illustrated in FIGS. 6 and 7, border structure 40 has bolt-receiving border-hole 47 therethrough which is isolated from border-portion 42 of chamber 14. And, frame structure 30 has bolt-receiving frame-holes 37 therethrough which are isolated from frame-portion 32 of chamber 14; frame-hole 37 is aligned with a respective border-hole 47. A bolt 13 passes through aligned pair of bolt-receiving holes 37 and 47 such that border structure 40 and frame structure 30 are bolted together while maintaining the air/water-tight condition of chamber 14.

Figure 3:
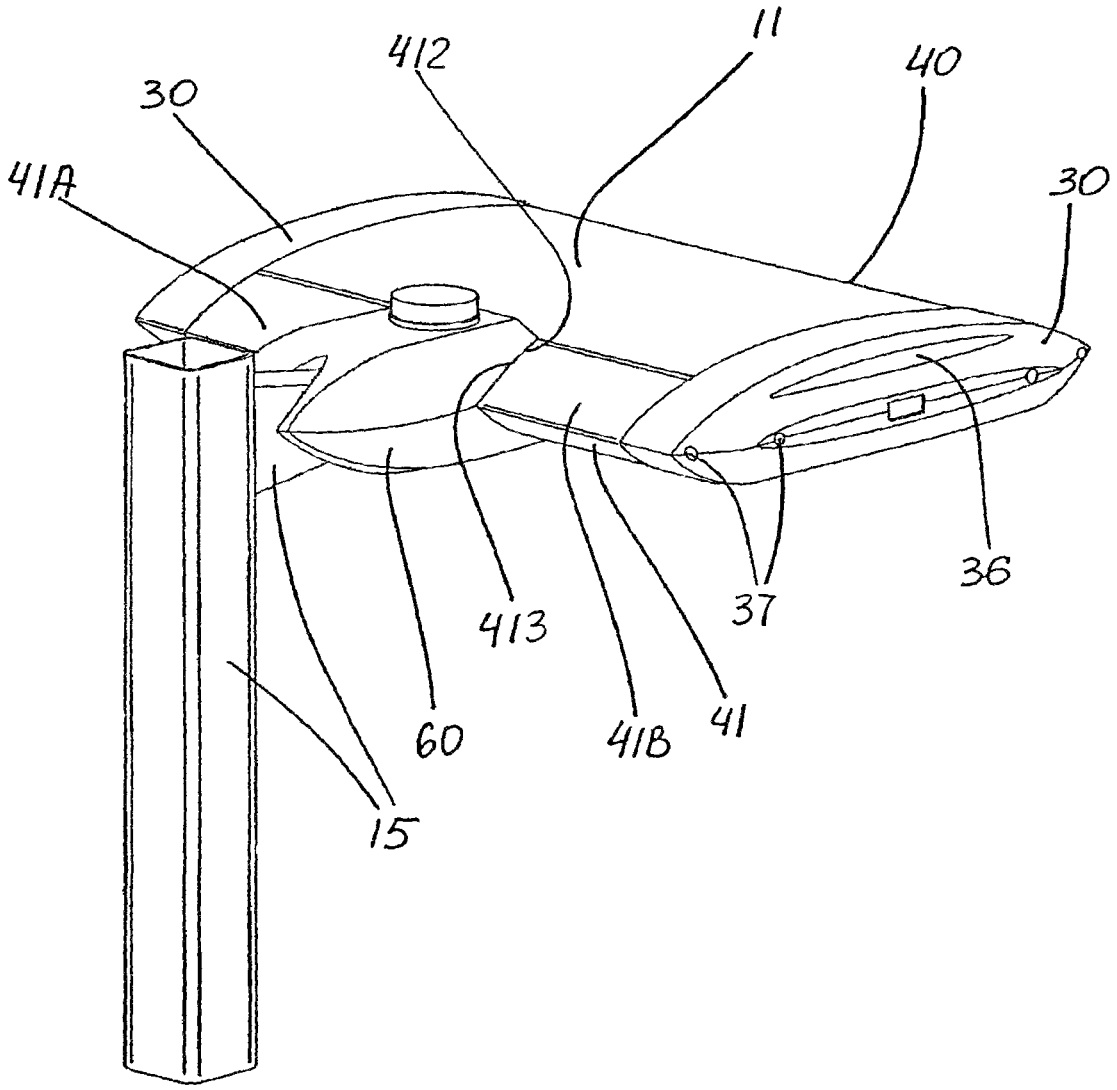
FIG. 3 is a perspective view of another LED lighting fixture including a pole-mounting assembly on a pole of square cross-section.

FIGS. 1 and 3 best illustrate certain highly preferred embodiments of this invention in which housing 12 is a perimetrical structure which includes a pair of opposed frame structures 30 and a pair of opposed nose structures 40, making perimetrical structure 12 of lighting fixture 10A substantially rectangular. FIGS. 1, 4-8 and 11 illustrate aspects of inventive LED lighting fixture 10A.

Figure 10:
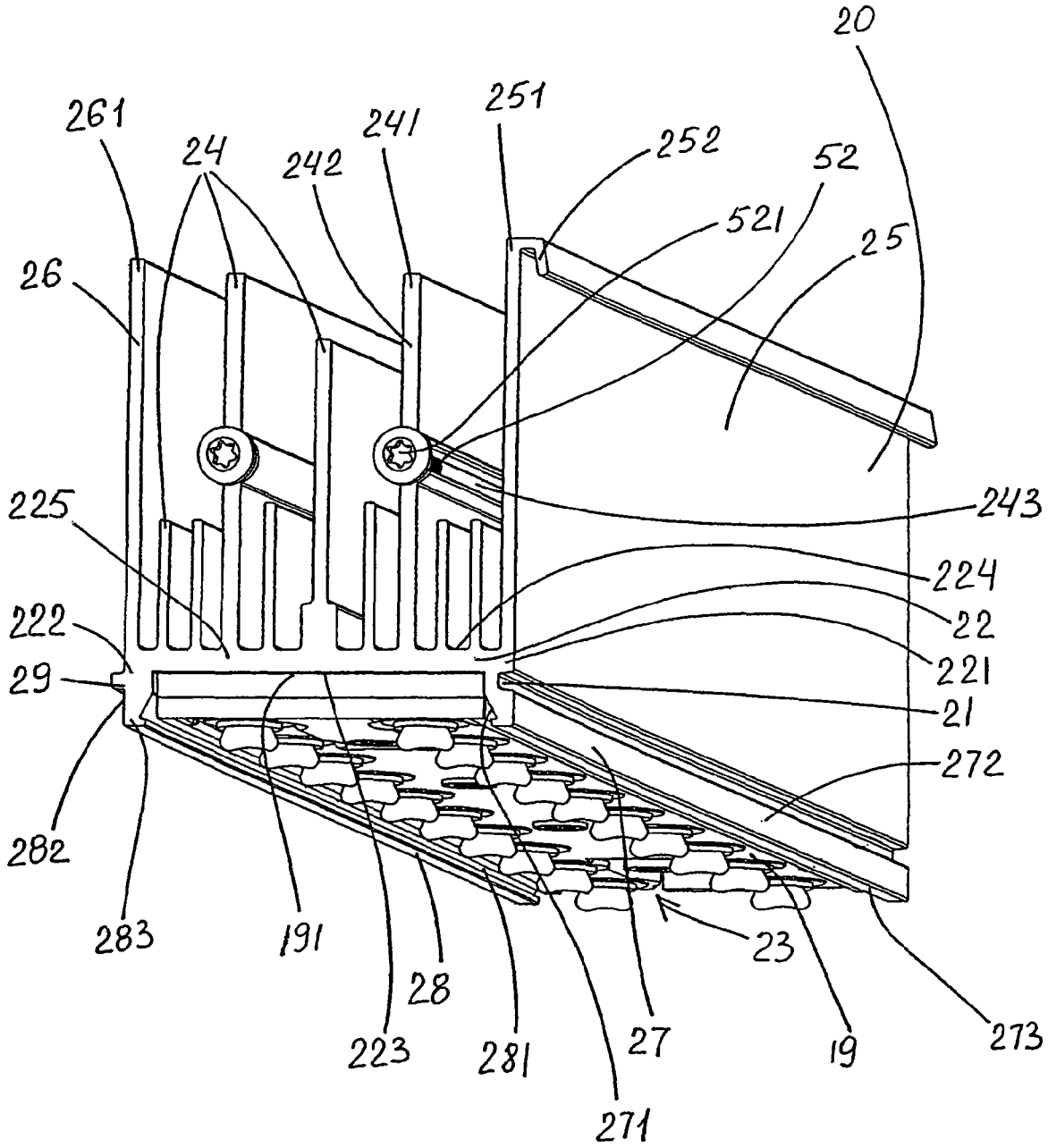
FIG. 10 is a perspective view of one LED-array module LED and its related LED heat sink of the LED assembly of the illustrated LED lighting fixtures.
Figure 11:
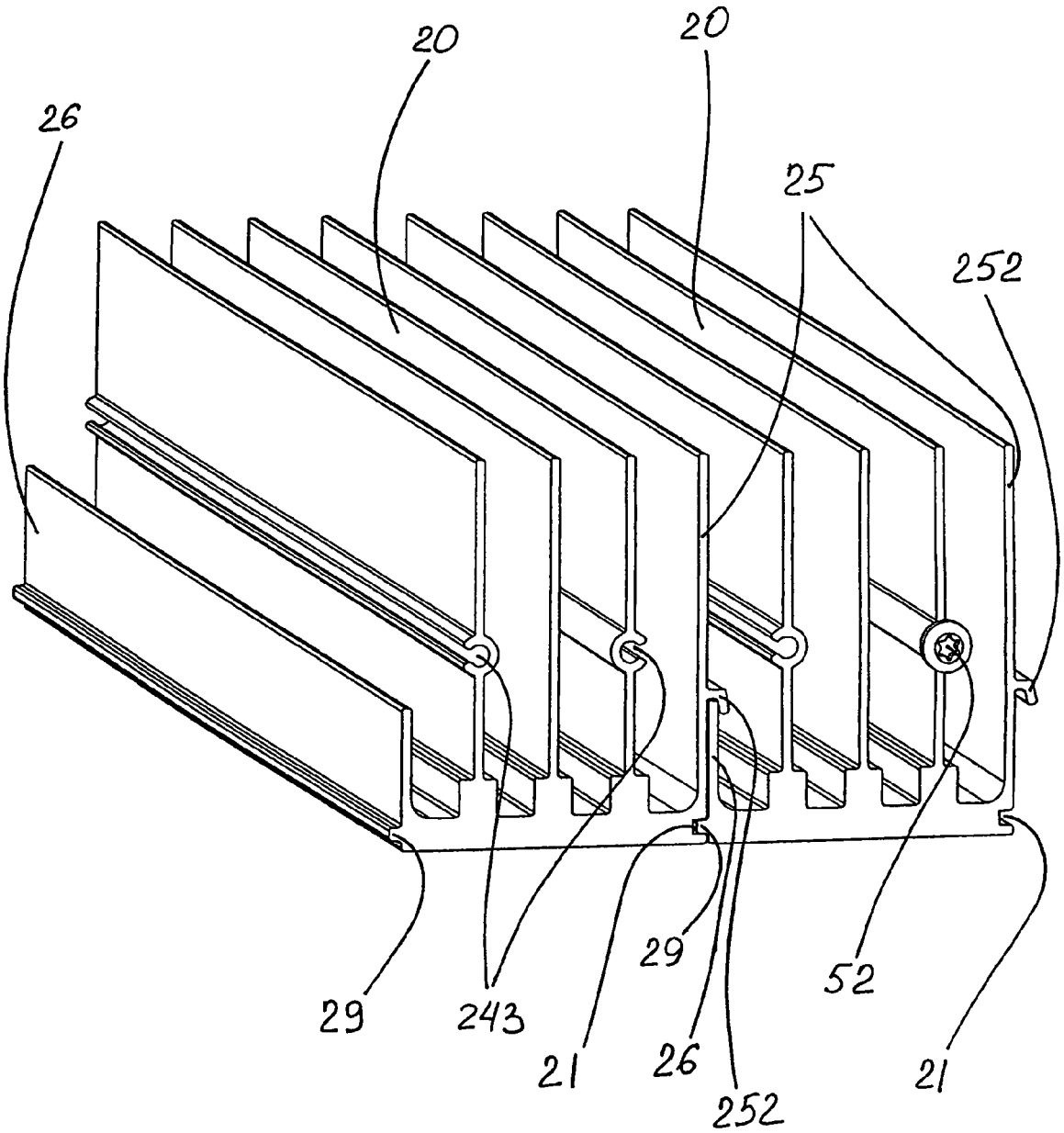
FIG. 11 is a perspective view of two interconnected LED heat sinks of the LED assembly of the illustrated LED lighting fixtures.

In LED lighting fixtures 10, LED assembly 18 includes a plurality of LED-array modules 19 each separately mounted on its corresponding LED heat sink 20, such LED heat sinks 20 being interconnected to hold LED-array modules 19 in fixed relative positions. Each heat sink 20 includes: a base 22 with a back base-surface 223, an opposite base-surface 224, two base-ends 225 and first and second base-sides 221 and 222; a plurality of inner-fins 24 protruding from opposite base-surface 224; first and second side-fins 25 and 26 protruding from opposite base-surface 224 and terminating at distal fin-edges 251 and 261, first side-fin 25 including a flange hook 252 positioned to engage distal fin-edge 261 of second side-fin 26 of adjacent heat sink 20; and first and second lateral supports 27 and 28 protruding from back base-surface 223, lateral supports 27 and 28 each having inner portions 271 and 281, respectively, and outer portion 272 and 282, respectively Inner portions 271 and 281 of first and second lateral supports 27 and 28 have first and second opposed support-ledges 273 and 283, respectively, that form a heat-sink-passageway 23 which slidably supports an LED-array module 19 against back base-surface 223. First and second supports 27 and 28 of each heat sink 20 are in substantially planar alignment with first and second side-fins 25 and 26, respectively. As seen in FIGS. 10 and 11, the flange hook is at 251 distal fin-edge of first side-fin 25.

Each heat sink 20 is a metal (preferably aluminum) extrusion with back base-surface 223 of heat sink 20 being substantially flat to facilitate heat transfer from LED-array module 19, which itself has a flat surface 191 against back-base surface 223. Each heat sink 20 also includes a lateral recess 21 at first base-side 221 and a lateral protrusion 29 at second base-side 222, recesses 21 and protrusions 29 being positioned and configured for mating engagement of protrusion 29 of one heat sink 20 with recess 21 of adjacent heat sink 20.

As best seen in FIGS. 1, 4, 5, 6, 10 and 11, first and second side-fins 25 and 26 are each a continuous wall extending along first and second base-sides 221 and 222, respectively Inner-fins 24 are also each a continuous wall extending along base 22. Inner-fins 24 are substantially parallel to side-fins 25 and 26.

Figure 4:
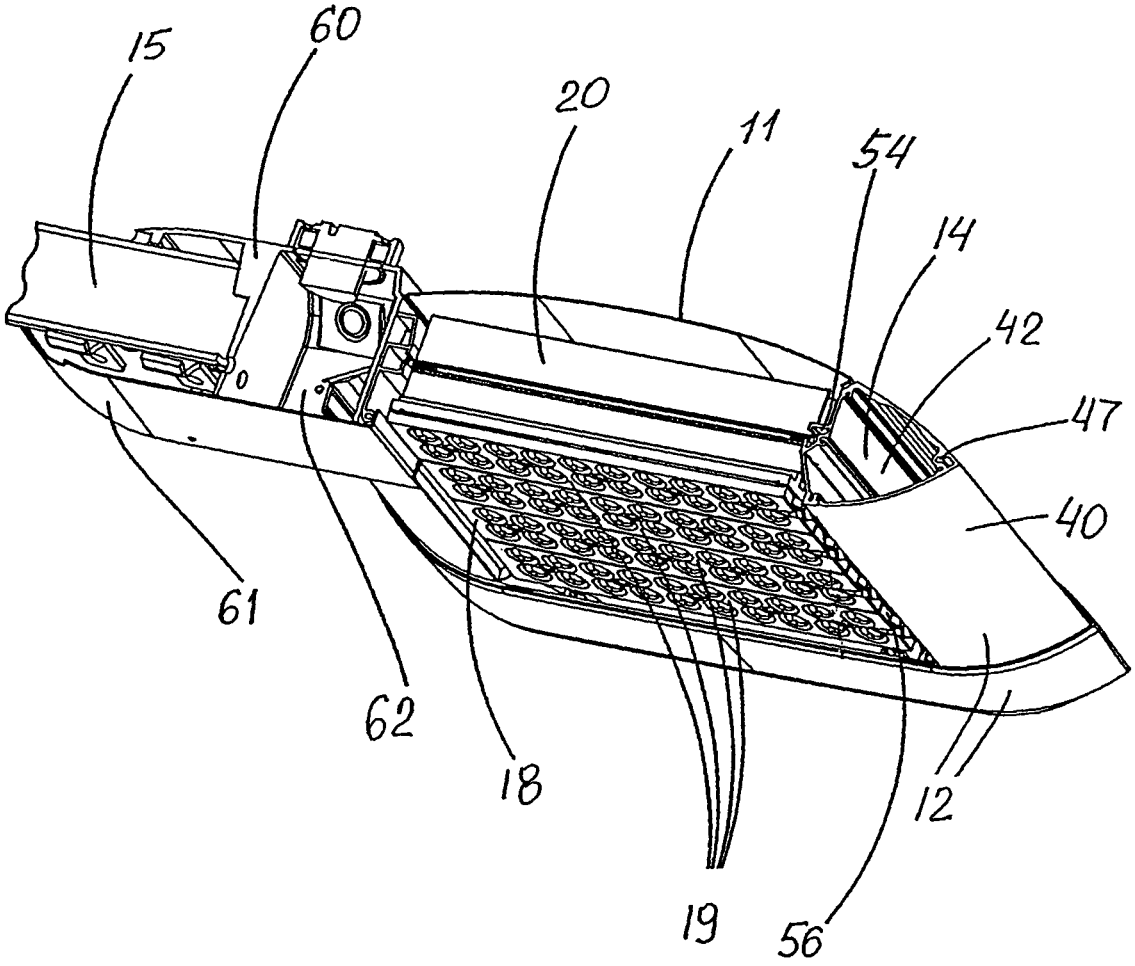
FIG. 4 is a side perspective view of the LED lighting of FIG. 1 broken away at a middle portion to show interior structure.
Figure 5:
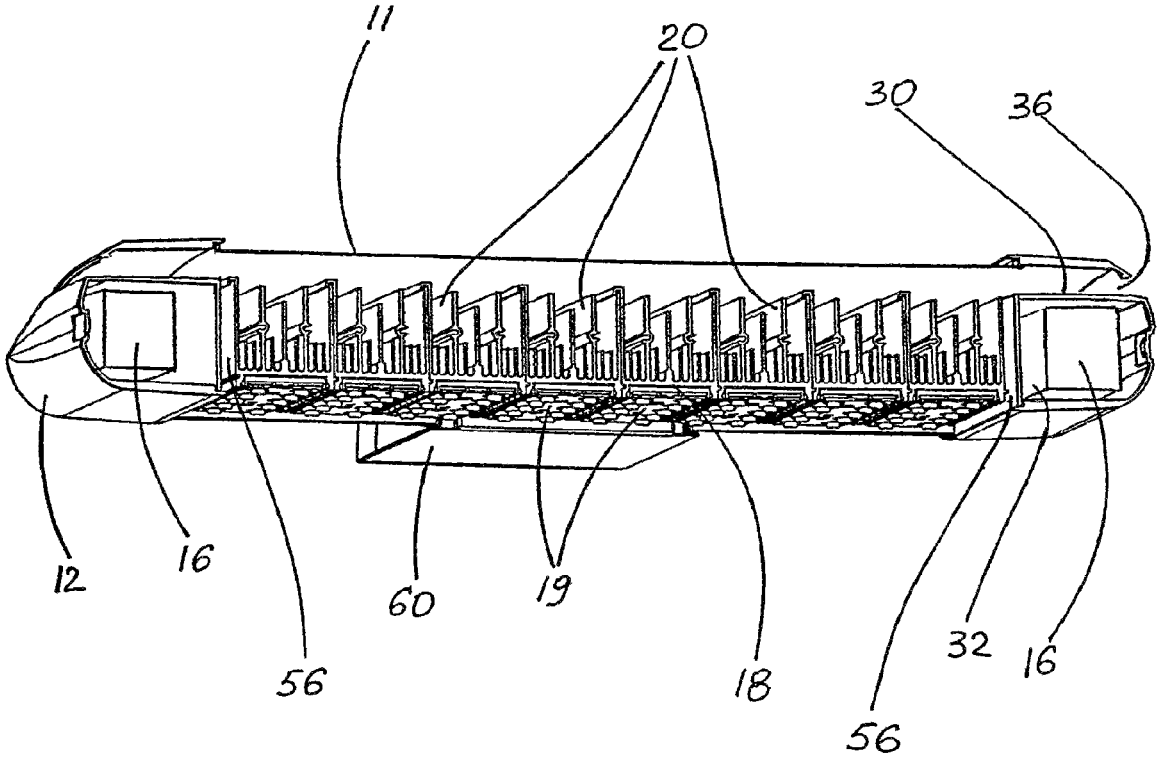
FIG. 5 is a front perspective view of the LED lighting of FIG. 1 broken away at a middle portion to show interior structure.

FIGS. 4 and 6 show an interlock of housing 12 to LED assembly 18. As best seen in FIGS. 10 and 11, in each heat sink 20 inner-fins 24 include two middle-fins 241 each of which includes a fin-end 242 forming a mounting hole 243. A coupler 52 in the form of a screw is engaged in mounting hole 243, and extends from heat sink 20 to terminate in a coupler-head 521. Housing 12 has a slotted cavity 54 which extends along, and is integrally formed with, each of border structures 40 forms the interlock by receiving and engaging coupler-heads 521 therein.

Figure 2:
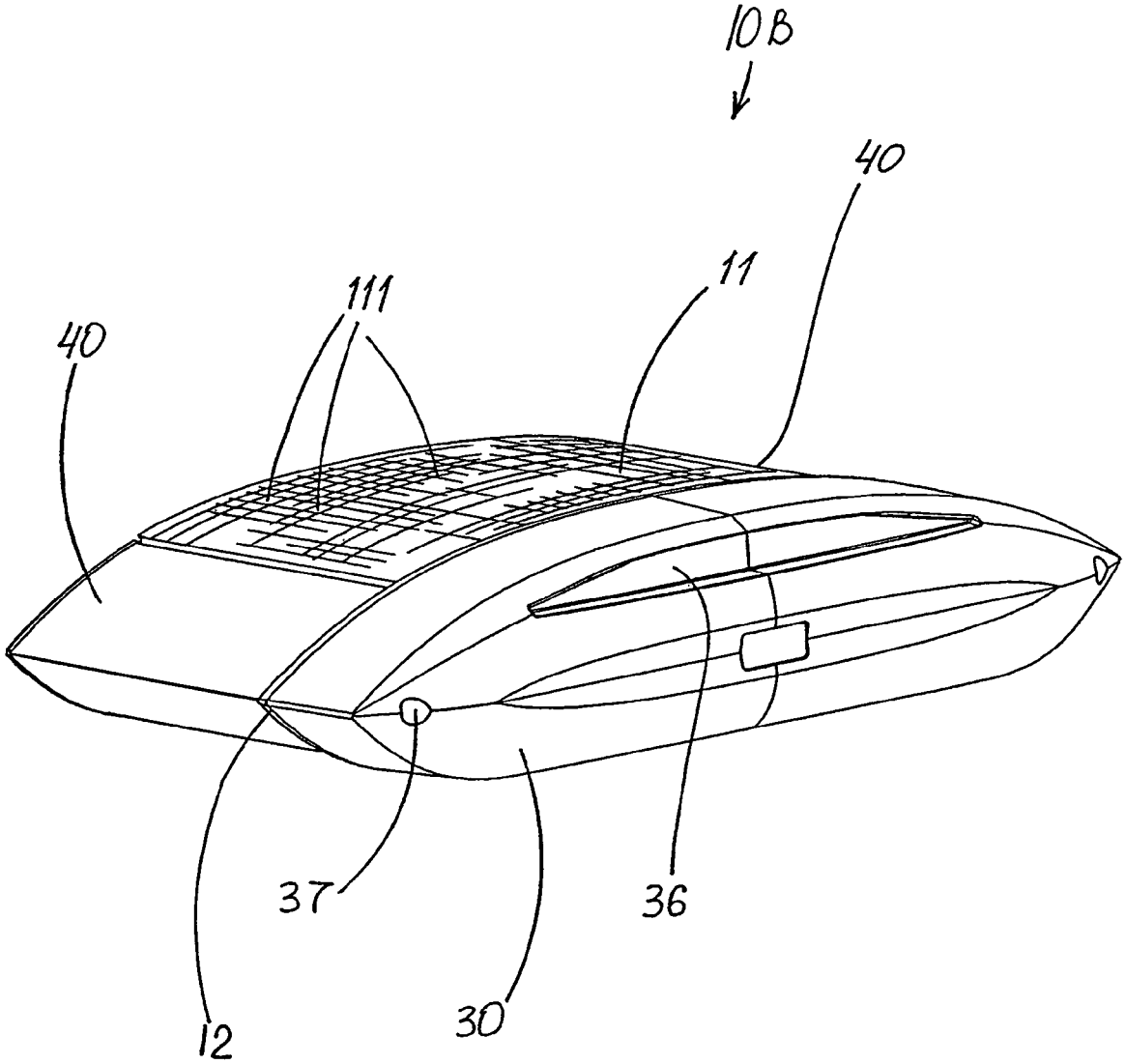
FIG. 2 is a perspective view of the LED lighting fixture configured for wall mounting.

FIG. 2 illustrates a version of the invention which is LED lighting fixture 10B. In lighting fixture 10B, perimetrical structure 12 includes a pair of nose structures 40 configured for wall mounting and one frame structure 30 in substantially perpendicular relationship to each of the two nose structures 40.

The substantially rectangular lighting fixture 10A which is best illustrated in FIGS. 1, 3 and 4, perimetrical structure 12 includes a pair of opposed frame structures 30 and a pair of opposed first nose structure 40 and second nose structure 41. The second nose structure 41 has two spaced sub-portions 41A and 41B with a gap 412 therebetween. Sub-portions 41A and 41B each include all of the nose-portion elements. Gap 412 accommodates a pole-mounting assembly 60, one embodiment of which is shown in FIGS. 1, 3, 4 and 12, that is secured to LED assembly 18 between nose sub-portions 41A and 41B.

Pole-mounting assembly 60 includes a pole-attachment portion 61 that receives and secures a pole 15 and a substantially air/water-tight section 62 that encloses electrical connections and has wire-apertures 64. Each wire-aperture 64 communicates with nose-portion 42 chamber of a respective one of nose-structure sub-portions 41A and 41B. Nose-structure sub-portions 41A and 41B are in air/water-tight engagement with air/water-tight section 62 of pole-mounting assembly 60. Air/water-tight section 62 includes grooves 621 on its opposite sides 622; grooves 621 are configured for mating engagement with end edges 413 of nose-structure sub-portions 41A and 41B.

Figure 12:
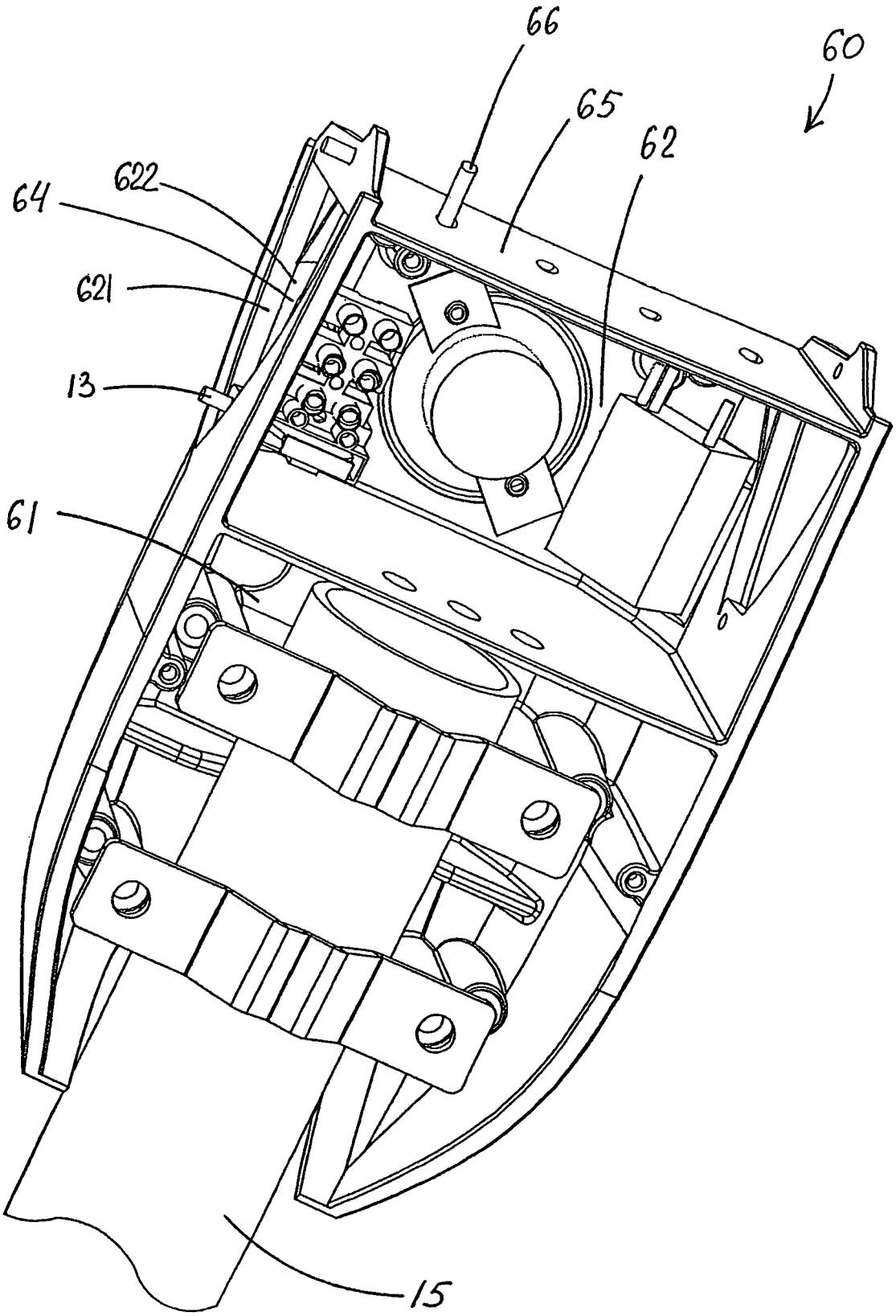
FIG. 12 is a fragmentary perspective view from below of the pole-mounting assembly engaged with a pole-attachment portion, with the cover of the pole-mounting assembly removed to show internal parts.

As best seen in FIG. 12, pole-mounting assembly 60 has a mounting plate 65 abutting LED assembly 18, and fastener/couplers 66 extend from mounting plate 65 into engagement with mounting hole 243 of middle-fins 241.

Figure 9:
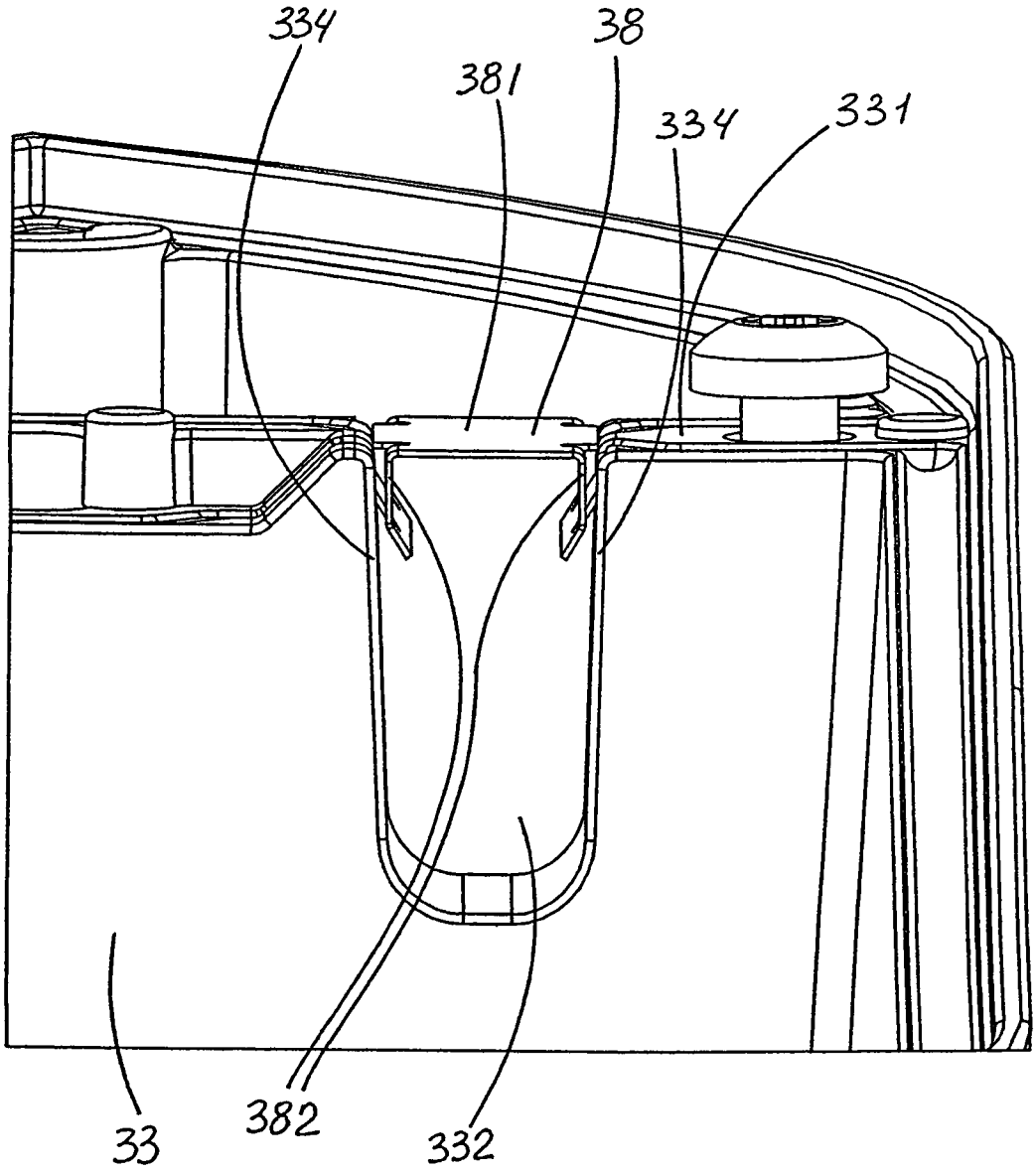
FIG. 9 is a greatly enlarged fragmentary perspective view showing a portion of the chamber-divider wall, the notch therein and the notch-bridge thereover.

FIGS. 8 and 9 show that frame-portion 32 of chamber 14 has a chamber-divider 33 across chamber 32 that divides frame-portion 32 of chamber 14 into an end part 321 and a main part 322, which encloses electronic LED driver(s) 16. Chamber-divider 33 has a divider-edge 331. Chamber-divider 33 includes a substantially air/water-tight wire-passage therethrough in the form of a notch 332 having spaced notch-wall ends 334 that terminate at divider-edge 331. A notch-bridge 38 spans notch 332 to maintain the air/water-tight condition of chamber 32. Notch-bridge 38 includes a bridge-portion 381 and a pair of gripping-portions 382 which are configured for spring-grip attachment to notch-wall ends 334. A removable cover-plate 31 seals main part 322 of frame-portion 32 of chamber 14 in substantially air/water-tight condition.

FIGS. 2-6 show that inventive LED lighting fixtures 10 include a protective cover 11 that extends over LED assembly 18 and is secured with respect to housing 12. Protective cover 11 has perforations 111 to permit air and water flow therethrough for access to and from LED assembly 18.

As best seen in FIGS. 5 and 6, LED lighting fixture 10 has a venting gap 56 between housing 12 and LED assembly 18, to permit air and water flow from heat sink 20. Venting gap 56 is formed by the interlock of housing 12 to LED assembly 18 or is a space along outer side-fins of the LED assembly.

Figure 13:
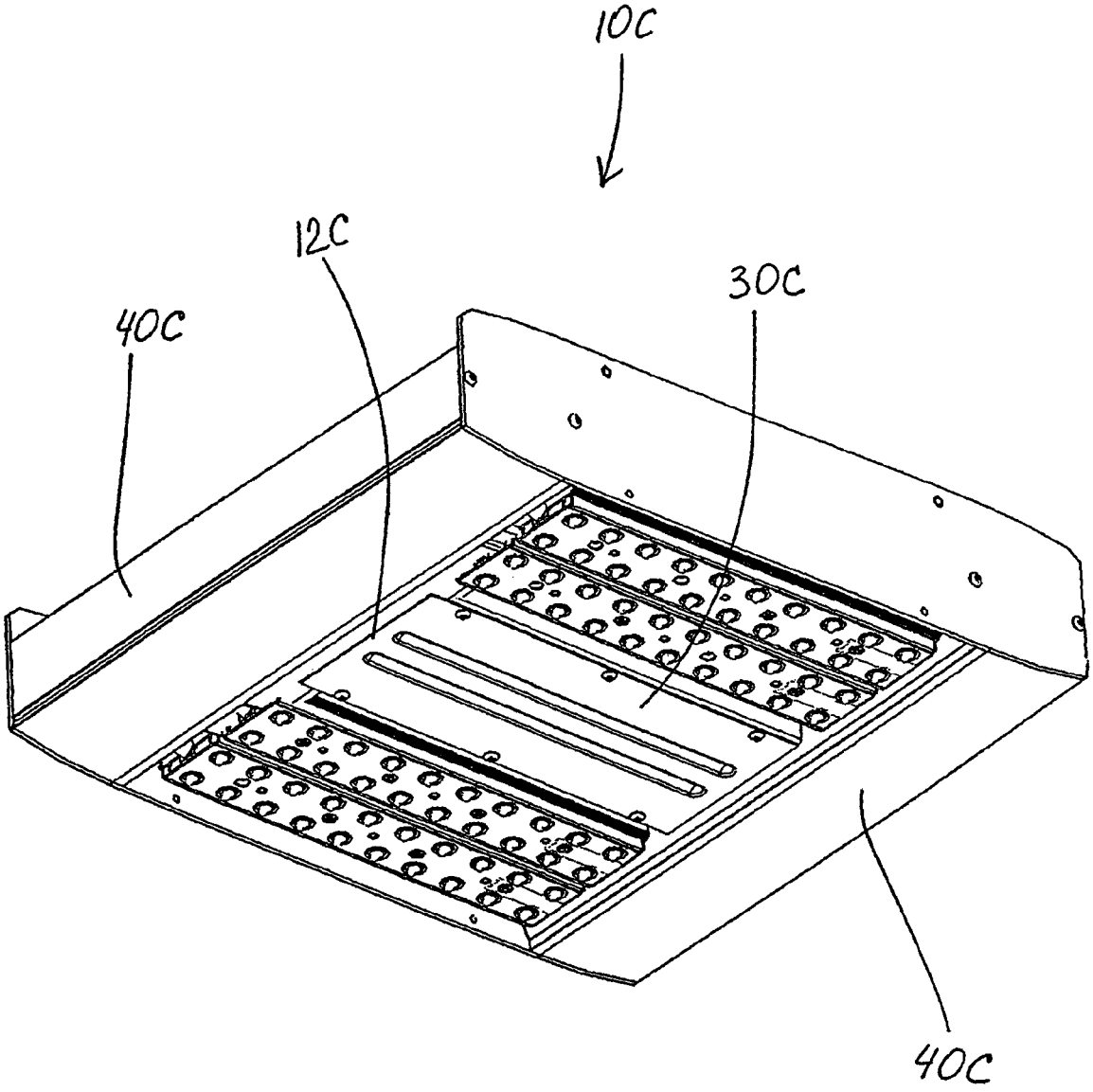
FIG. 13 is a perspective view of the LED lighting fixture of the type having the housing being a substantially H-shaped structure.

FIG. 13 shows an embodiment of the inventive lighting fixture 10C in which frame structure 30C is a sole frame structure, and housing 12C is a substantially H-shaped structure with sole frame structure 30C secured between mid-length positions of the pair of opposed border structures 40C.

Figure 14:
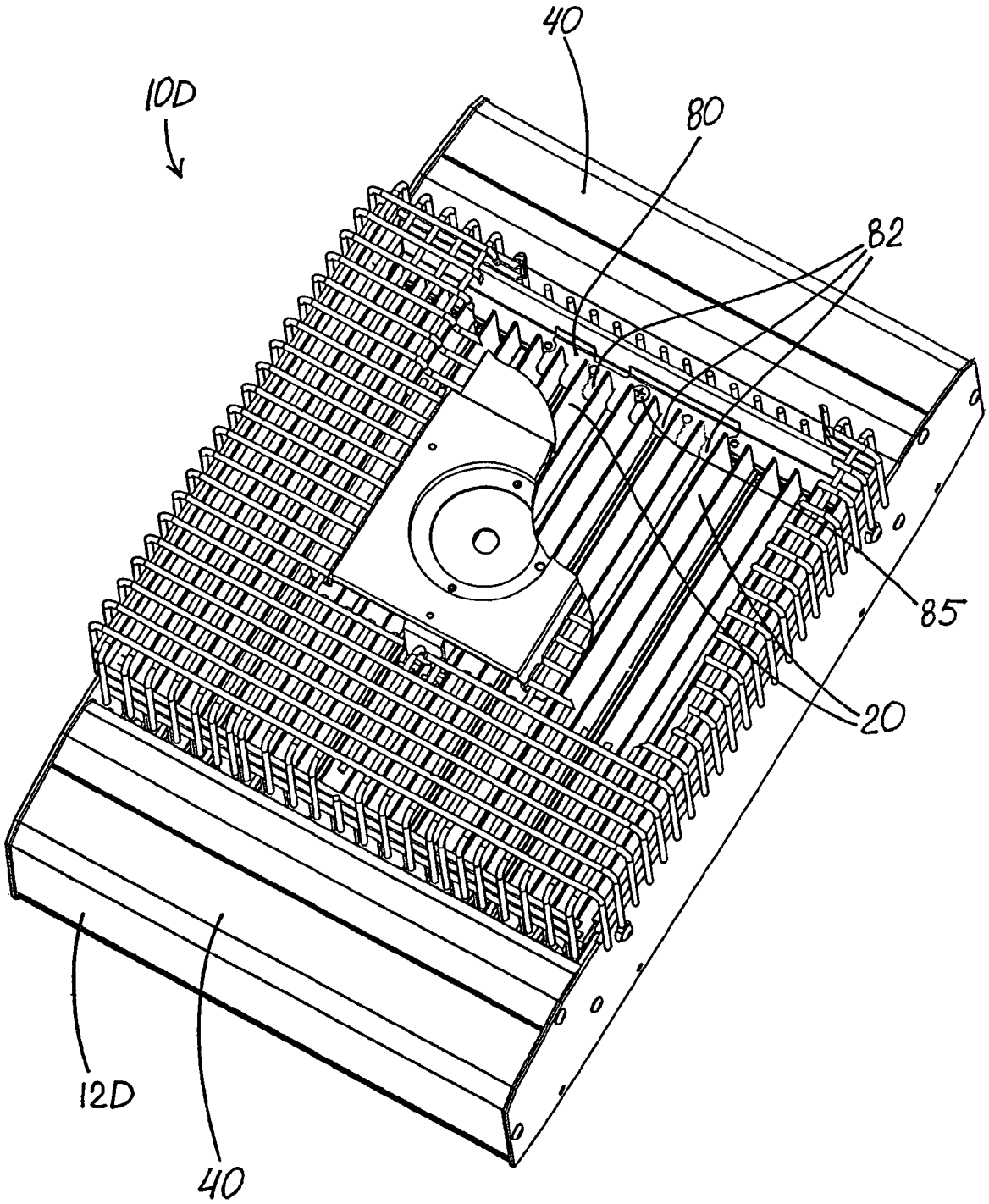
FIG. 14 is a top perspective view of another embodiment of the LED lighting fixture including a restraining bracket seen through a cut-away in the protective cover.
Figure 15:
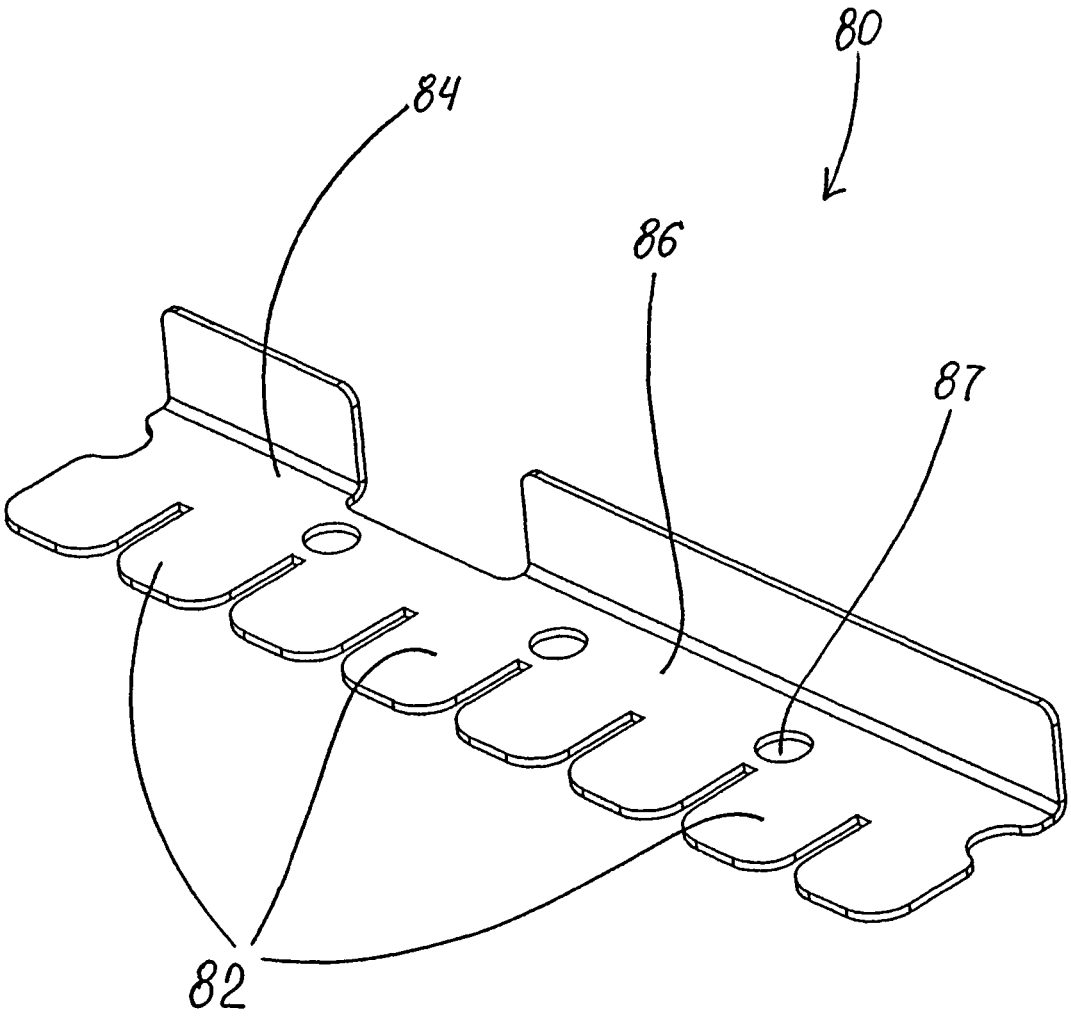
FIG. 15 is a perspective view of the restraining bracket of FIG. 14.

FIG. 14 shows another embodiment of the inventive LED lighting fixture 10D with housing 12D formed by a pair of opposed border structures 40 and LED assembly 18 secured between border structures 40. Lighting fixture 10D, as shown on FIG. 14, includes a restraining-bracket 80 secured to housing 12D by screws 85 through screw-holes 87. Bracket 80 has a plurality of projections 82 each of which extends between adjacent fins of two of heat sinks 20. Restraining bracket 80, best shown on FIG. 15, is a comb-like structure with an elongated body 84 including a spine-portion 86 from which the plurality of projections 82 extend. Restraining-bracket 80 is configured and dimensioned for elongated body 84 to be fixedly secured to housing 12 and for projections 82 to snugly fit in spaces between adjacent heat-sink fins.

While the principles of the invention have been shown and described in connection with specific embodiments, it is to be understood that such embodiments are by way of example and are not limiting.

The invention claimed is:

1. A light fixture comprising a chamber, at least one power-circuitry driver within the chamber, at least one LED module outside the chamber, and at least one air gap between the chamber and the at least one LED module, the air gap permitting air/water-flow therethrough.

2. The light fixture of claim 1 wherein the chamber is defined by a housing.

3. The light fixture of claim 2 wherein the at least one LED module is on an LED heat sink outside the chamber.

4. The light fixture of claim 3 wherein the housing defines the air gap permitting air/water-flow to and from the heat sink.

5. The light fixture of claim 3 wherein the heat sink is a separate structure connected with respect to the housing.

6. The light fixture of claim 5 wherein the housing and the heat sink define the air gap therebetween.

7. The light fixture of claim 3 wherein the heat sink is open to air/water-flow thereover.

8. The light fixture of claim 3 wherein at least one end of the heat sink is at the chamber and is open to the air gap.

9. The light fixture of claim 3 wherein the heat sink has a module-engaging surface and a heat-dissipating surface.

10. The light fixture of claim 9 wherein the heat-dissipating surface includes at least one fin protruding therefrom.

11. The light fixture of claim 3 wherein the at least one LED module includes a plurality of modules.

12. The light fixture of claim 11 wherein the heat sink comprises a plurality of interconnected heat sinks.

* * * * *